US008960264B2

(12) United States Patent
Mahapatra et al.

(10) Patent No.: US 8,960,264 B2
(45) Date of Patent: Feb. 24, 2015

(54) METHOD AND APPARATUS FOR CONTROLLING VARIABLE SHELL THICKNESS IN CAST STRIP

(71) Applicant: Nucor Corporation, Charlotte, NC (US)

(72) Inventors: Rama Ballav Mahapatra, Brighton-le-Sands (AU); David W. McGaughey, Waveland, IN (US); Jay Jon Ondrovic, Brownsburg, IN (US); Tim Patterson, Blytheville, AR (US); Mike Schueren, Crawfordsville, IN (US)

(73) Assignee: Nucor Corporation, Charlotte, NC (US)

( * ) Notice: Subject to any disclaimer, the term of this patent is extended or adjusted under 35 U.S.C. 154(b) by 56 days.

(21) Appl. No.: 13/826,593

(22) Filed: Mar. 14, 2013

(65) Prior Publication Data

US 2013/0174995 A1 Jul. 11, 2013

Related U.S. Application Data

(62) Division of application No. 12/916,096, filed on Oct. 29, 2010.

(60) Provisional application No. 61/256,904, filed on Oct. 30, 2009.

(51) Int. Cl.
*B22D 11/06* (2006.01)
*B22C 9/06* (2006.01)

(52) U.S. Cl.
CPC ..... *B22D 11/06* (2013.01); *B22D 11/0622* (2013.01); *B22C 9/06* (2013.01)
USPC ..... 164/428; 164/480

(58) Field of Classification Search
CPC ..... B22D 11/06; B22D 11/0622
USPC ..... 164/428, 480
See application file for complete search history.

(56) References Cited

U.S. PATENT DOCUMENTS

| | | | |
|---|---|---|---|
| 4,887,662 | A | 12/1989 | Tanaka et al. |
| 5,179,996 | A | 1/1993 | Blin et al. |
| 7,073,565 | B2 | 7/2006 | Nikolovski et al. |

FOREIGN PATENT DOCUMENTS

| | | |
|---|---|---|
| EP | 0546885 | 6/1993 |
| JP | 9-001296 | 1/1997 |
| JP | 2007-021504 | 2/2007 |
| KR | 1000829951 | 5/2008 |

*Primary Examiner* — Kevin P Kerns
(74) *Attorney, Agent, or Firm* — Hahn Loeser + Parks LLP; Arland T. Stein

(57) ABSTRACT

Apparatus and method for continuously casting metal strip includes a pair of casting rolls having casting surfaces with a center portion, edge portions each having average surface roughness between 3 and 7 Ra, and intermediate portion between each edge portion and the center portion, the center portion average surface roughness between 1.2 and 4.0 times the edge portion surface roughness, and the intermediate portions average surface roughness between that of the edge and center portions. The surface roughness of the center portion is tapered across its width, and may be tapered across its width is in stepped zones. The center portion may have surface roughness varied across the surface to correspond to a desired variation in metal shell thickness across the cast strip. The center portion may be at least 60% of the casting roll width, and each edge portion may be up to 7% of the casting roll width.

47 Claims, 20 Drawing Sheets
(2 of 20 Drawing Sheet(s) Filed in Color)

| Zone | Air Pressure (psi) | Shot Flow (lbs/min) | mm from end | mm per zone | Ra | Nozzle traverse speed (inch/min) |
|---|---|---|---|---|---|---|
| 1 | 20 | 23 | 0-12 | 12 | 4 | .75 IPM |
| 2 | 20 | 23 | 12-50 | 38 | 4 | 1.00 IPM |
| 3 | 70 | 23 | 50-62 | 12 | 8 | 1.25 IPM |
| 4 | 86 | 23 | 62-142 | 80 | 13 | 1.5 IPM |
| 5 | 66 | 23 | 142-222 | 80 | 12 | 1.5 IPM |
| 6 | 57 | 23 | 222-322 | 100 | 11 | 1.5 IPM |
| 7 | 50 | 23 | 322-422 | 100 | 10 | 1.5 IPM |
| 8 | 46 | 23 | 422-922 | 500 | 9 | 1.5 IPM |
| 9 | 50 | 23 | 922-1022 | 100 | 10 | 1.5 IPM |
| 10 | 57 | 23 | 1022-1122 | 100 | 11 | 1.5 IPM |
| 11 | 66 | 23 | 1122-1202 | 80 | 12 | 1.5 IPM |
| 12 | 86 | 23 | 1202-1282 | 80 | 13 | 1.5 IPM |
| 13 | 70 | 23 | 1282-1294 | 12 | 8 | 1.25 IPM |
| 14 | 20 | 23 | 1294-1332 | 38 | 4 | 1.75 IPM |
| 15 | 20 | 23 | 1332-1344 | 12 | 4 | .75 IPM |
| nozzle distance | roll rotation speed | shot size | nozzle angle | # of passes | roll Ra prior to blasting | |
| 3 3/8" | 16 RPM | 330 | 90 degrees | 2 | < 1 RA | |

METHOD AND APPARATUS FOR CONTROLLING VARIABLE SHELL THICKNESS IN CAST STRIP

This patent application is a divisional of U.S. patent application Ser. No. 12/916,096 filed on Oct. 29, 2010, which claims priority to and the benefit of U.S. Provisional Patent Application 61/256,904 filed Oct. 30, 2009.

BACKGROUND AND SUMMARY

This invention relates to the casting of metal strip by continuous casting in a twin roll caster.

In a twin roll caster molten metal is introduced between a pair of counter-rotated horizontal casting rolls that are cooled so that metal shells solidify on the moving roll surfaces and are brought together at a nip between them to produce a solidified strip product delivered downwardly from the nip between the rolls. The term "nip" is used herein to refer to the general region at which the rolls are closest together. The molten metal may be poured from a ladle into a smaller vessel or series of smaller vessels from which it flows through a metal delivery nozzle located above the nip, so forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow.

The twin roll caster may be capable of continuously producing cast strip from molten steel through a sequence of ladles. Pouring the molten metal from the ladle into smaller vessels before flowing through the metal delivery nozzle enables the exchange of an empty ladle with a full ladle without disrupting the production of cast strip.

During casting, the casting rolls rotate such that metal from the casting pool solidifies into shells on the casting rolls that are brought together at the nip to produce a cast strip downwardly from the nip. One of the difficulties in the past has been high frequency chatter, which should be avoided because of surface defects caused in the strip. Temperature increase as the cast strip leaves the nip, called temperature rebound, is also a concern, and can cause enlargement of the shell due to ferrostatic pressure from the casting pool resulting in ridges in the strip. Temperature rebound occurs when the center of the strip contains "mushy" material, i.e. the metal between the shells that has not solidified to be self-supporting, and the latent heat from the center material will cause the shells to reheat after leaving the casting rolls.

We have found that the defects caused by high frequency chatter and temperature rebound can be controlled by maintaining and controlling the amount of mushy material that is "swallowed" in the cast strip and subsequently cooled. Some mushy material sandwiched between the solidified shells is provided to cushion the unevenness in the growth and cooling of the shells and inhibits if not eliminates high frequency chatter and the attendant strip defects. At the same time, the amount of mushy material between the solidified shells is controlled to reduce and control the amount of temperature rebound in the cast strip. If the rebound temperature is too high, it can cause at least partial remelting of the solidified shells and defects in the strip such as ridges, and in severe circumstances, breakage of the strip where the temperature is so high as to remelt the shells. The mushy material may include molten metal and partially solidified metal, and includes all the material between the shells not sufficiently solidified to be self supporting.

To further explain, the mushy material in the strip is in communication immediately below the nip with the casting pool subject to the ferrostatic pressure. When an excess amount of mushy material is between the shells of the strip below the nip, a high temperature rebound begins to re-melt and weaken the solidified shells of the cast strip. Weakened shells may locally bulge due to the ferrostatic pressure causing local excessive strip budge and surface defects in the cast strip, and with severe weakening may cause strip breakage. Also, when an excess amount of mushy material is between the shells near the strip edges, the mushy material may enlarge the edges of the strip causing "edge bulge," or may drip from the edges of the cast strip causing "edge droop" and "edge loss."

This temperature rebound from reheating caused by the mushy material can also effect the microstructure of the cast strip. We have found desired properties by maintaining a consistent austenitic microstructure in the cast strip at the hot rolling mill downstream of the caster. The increased temperature from temperature rebound may re-heat the strip to a temperature forming δ-ferrite, which upon cooling returns to a finer and more variable austenite microstructure.

Compounding the reheating problem is the crown shape in the typical casting rolls. As a result, the cast strip produced downwardly from the nip between the casting rolls is, for example, between 10 and 100 micrometers thicker in the center portion of the strip than adjacent edge portions. To form such cast strip having a crown, the casting rolls may have the negative crown with a circumference smaller in a center portion of the casting rolls than the circumference adjacent the strip edges. The casting rolls may be made with the casting roll surfaces slightly hyperboloid in shape. The effect of each casting roll having a casting roll circumference that is smaller in the center portion than the circumference adjacent edge portions is the strip cast is thicker in the center than adjacent the edges. In the past, this tended to cause weakening of the solidified shells in the center portion of the strip since a thicker mushy material and attendant higher temperature would tend to cause the shells in the center portion to remelt more easily and rapidly. We have found that the resulting variable amount of mushy material between the casting rolls may provide an excess amount of mushy material at the center portion of the strip than at the edge portions of the strip resulting in undesired ridges in the cast strip.

We have found a method of compensating and controlling shell formation during casting so that the solidified shells can be thicker in the center portion of the cast strip even with a substantial casting roll crown and resulting cast strip crown. We presently disclose a method for directly controlling the shell thicknesses across the cast strip so the shells and the cast strip produced is thicker in the center portion of the strip. This in turn reduces the amount of mushy material between the casting rolls at the center portion, reducing the amount of mushy material between the shells at the center portion and controlling temperature rebound and attendant strip defects, while inhibiting high frequency chatter.

Disclosed is a method of continuously casting metal strip comprising:

(a) assembling a pair of counter-rotatable casting rolls to form a gap at a nip between the casting rolls through which thin cast strip can be cast, each having casting surfaces with a center portion of at least 60% of the width of the casting rolls, two edge portions each of up to 7% of the width of the casting rolls, and at least one intermediate portion between each edge portion and the center portion, each edge portion having an average surface roughness between 3 and 7 Ra, the center portion having an average surface roughness between 1.2 and 4.0 times the surface roughness of the edge portions, and the intermediate portions having an average surface roughness between average surface roughness of the edge portions and the center portion, (b) assembling a metal delivery system adapted to deliver molten metal above the nip to form a casting pool supported on the casting surfaces of the casting rolls and confined at the edges of the casting rolls, and (c) counter-rotating the casting rolls to form metal shells on the casting surfaces of the casting rolls that are brought together at the nip to deliver cast strip downwardly with varied thicknesses of the metal shells across the strip width.

In the disclosed method, the surface roughness of the center portion may be tapered across its width. For example, the taper of the surface roughness of the center portion across its width may be in stepped zones.

The surface roughness of the center portion may be tapered across its width with the middle part of the center portion at least 2 Ra below the surface roughness at outmost parts of the center portion. The edge portions may have an average surface roughness of between 5 and 7 Ra. Alternatively, the edge portions may have an average surface roughness of between 3 and 6 Ra. Alternatively or additionally, the surface roughness across each edge portion may be within 1.0 Ra.

In one alternative, the surface roughness of the center portion may be substantially similar across the width.

The surface roughness of the casting surface of the center portion of the casting rolls is varied in a range between 5 and 15 Ra. Alternatively, the surface roughness of the casting surface of the center portion of the casting rolls is varied in stepped zones in a range between 5 and 12 Ra. In one alternative, the casting rolls have a crown shape adapted to form a crown in the cast strip, and the crown shape of the casting roll surface of each casting roll is coordinated with variation in surface roughness across the center portion of the casting surface. The crown shape may be provided in stepped zones.

Additionally or alternatively, the surface roughness of the casting surface over the width of the casting rolls may be varied in a range between 5 and 15 Ra. The surface roughness of the casting surface over the width of the casting rolls may be varied in stepped zones in a range between 5 and 12 Ra. In one alternative, the casting rolls have a crown shape adapted to form a crown in the cast strip, and the crown shape of the casting roll surface of each casting roll is coordinated with variation in surface roughness across the width of the casting surface. The crown shape may be provided in stepped zones.

The surface roughness of the casting surface of the center portion of the casting rolls is varied to correspond to a desired variation in metal shell thickness formed for the cast strip.

The edge portion of each casting roll may be between 50 mm and 75 mm wide. Alternatively, the edge portion of each casting roll is between 25 mm and 75 mm wide.

The casting rolls may be between 450 and 650 mm in diameter.

The casting rolls may have a crown shape adapted to form a crown in the cast strip, and the crown shape of the casting roll surface of each casting roll is such that edge portions of the cast strip are of a higher temperature than the cast strip in the center portion of the strip width.

The as-cast thickness of the cast strip may be between about 0.6 and 2.4 millimeters, and the casting pool height may be between about 125 and 225 millimeters above the nip.

In addition, an apparatus is disclosed for continuously casting metal strip comprising:

(a) a pair of counter-rotatable casting rolls each having casting surfaces with a center portion of at least 60% of the width of the casting rolls, two edge portions each of up to 7% of the width of the casting rolls, and at least one intermediate portion between each edge portion and the center portion, each edge portion having an average surface roughness between 3 and 7 Ra, the center portion having an average surface roughness between 1.2 and 4.0 times the surface roughness of the edge portions, and the intermediate portions having an average surface roughness between average surface roughness of the edge portions and the center portion, and laterally positioned to form a gap at a nip between the casting surfaces of the casting rolls through which thin cast strip can be cast, (b) a metal delivery system adapted to deliver molten metal above the nip to form a casting pool supported on the casting surfaces of the casting rolls and confined at the edges of the casting rolls, and (c) a drive system adapted to counter-rotate the casting rolls forming metal shells on the casting surfaces of the casting rolls on the casting surfaces of the casting rolls that are brought together at the nip to deliver cast strip downwardly with varied thicknesses of the metal shells across the strip width.

In the disclosed apparatus, the surface roughness of the center portion may be tapered across its width. For example, the taper of the surface roughness of the center portion across its width may be in stepped zones.

The surface roughness of the center portion may be tapered across its width with the middle part of the center portion at least 2 Ra below the surface roughness at outmost parts of the center portion. The edge portions may have an average surface roughness of between 5 and 7 Ra. Alternatively, the edge portions may have an average surface roughness of between 3 and 6 Ra. Alternatively or additionally, the surface roughness across each edge portion may be within 1.0 Ra.

In one alternative, the surface roughness of the center portion may be substantially similar across the width.

The surface roughness of the casting surface of the center portion of the casting rolls is varied in a range between 5 and 15 Ra. Alternatively, the surface roughness of the casting surface of the center portion of the casting rolls is varied in stepped zones in a range between 5 and 12 Ra. In one alternative, the casting rolls have a crown shape adapted to form a crown in the cast strip, and the crown shape of the casting roll surface of each casting roll is coordinated with variation in surface roughness across the center portion of the casting surface. The crown shape may be provided in stepped zones.

Additionally or alternatively, the surface roughness of the casting surface over the width of the casting rolls may be varied in a range between 5 and 15 Ra. The surface roughness of the casting surface over the width of the casting rolls may be varied in stepped zones in a range between 5 and 12 Ra. In one alternative, the casting rolls have a crown shape adapted to form a crown in the cast strip, and the crown shape of the casting roll surface of each casting roll is coordinated with variation in surface roughness across the width of the casting surface. The crown shape may be provided in stepped zones.

The surface roughness of the casting surface of the center portion of the casting rolls is varied to correspond to a desired variation in metal shell thickness formed for the cast strip.

The edge portion of each casting roll may be between 50 mm and 75 mm wide. Alternatively, the edge portion of each casting roll is between 25 mm and 75 mm wide.

The casting rolls may be between 450 and 650 mm in diameter.

The casting rolls may have a crown shape adapted to form a crown in the cast strip, and the crown shape of the casting roll surface of each casting roll is such that edge portions of the cast strip are of a higher temperature than the cast strip in the center portion of the strip width.

The as-cast thickness of the cast strip may be between about 0.6 and 2.4 millimeters, and the casting pool height may be between about 125 and 225 millimeters above the nip.

Also disclosed is a method of continuously casting metal strip with reduced ridges comprising:

(a) assembling a pair of counter-rotatable casting rolls to form a gap at a nip between the casting rolls through which thin cast strip can be cast, each having casting surfaces with a center portion and edge portion, the center portion having surface roughness varied across said center portion to correspond to a desired variation in metal shell thickness across the cast strip, (b) assembling a metal delivery system adapted to deliver molten metal above the nip to form a casting pool supported on the casting surfaces of the casting rolls and confined at the edges of the casting rolls, and (c) counter-rotating the casting rolls to form metal shells on the casting surfaces of the casting rolls that are brought together at the nip to deliver cast strip downwardly with varied thicknesses of the metal shells across the strip width.

The surface roughness of the center portion may be tapered across its width. For example, the taper of the surface roughness of the center portion across its width may be in stepped zones.

The surface roughness of the center portion may be tapered across its width with the middle part of the center portion at least 2 Ra below the surface roughness at outmost parts of the center portion. The edge portions may have an average surface roughness of between 5 and 7 Ra. Alternatively, the edge portions may have an average surface roughness of between 3 and 6 Ra. Alternatively or additionally, the surface roughness across each edge portion may be within 1.0 Ra.

In one alternative, the surface roughness of the center portion may be substantially similar across the width.

The surface roughness of the casting surface of the center portion of the casting rolls is varied in a range between 5 and 15 Ra. Alternatively, the surface roughness of the casting surface of the center portion of the casting rolls is varied in stepped zones in a range between 5 and 12 Ra. In one alternative, the casting rolls have a crown shape adapted to form a crown in the cast strip, and the crown shape of the casting roll surface of each casting roll is coordinated with variation in surface roughness across the center portion of the casting surface. The crown shape may be provided in stepped zones.

Additionally or alternatively, the surface roughness of the casting surface over the width of the casting rolls may be varied in a range between 5 and 15 Ra. The surface roughness of the casting surface over the width of the casting rolls may be varied in stepped zones in a range between 5 and 12 Ra. In one alternative, the casting rolls have a crown shape adapted to form a crown in the cast strip, and the crown shape of the casting roll surface of each casting roll is coordinated with variation in surface roughness across the width of the casting surface. The crown shape may be provided in stepped zones.

The surface roughness of the casting surface of the center portion of the casting rolls is varied to correspond to a desired variation in metal shell thickness formed for the cast strip.

The edge portion of each casting roll may be between 50 mm and 75 mm wide. Alternatively, the edge portion of each casting roll is between 25 mm and 75 mm wide.

The casting rolls may be between 450 and 650 mm in diameter.

The casting rolls may have a crown shape adapted to form a crown in the cast strip, and the crown shape of the casting roll surface of each casting roll is such that edge portions of the cast strip are of a higher temperature than the cast strip in the center portion of the strip width.

The as-cast thickness of the cast strip may be between about 0.6 and 2.4 millimeters, and the casting pool height may be between about 125 and 225 millimeters above the nip.

The apparatus for continuously casting metal strip with reduced ridges may comprise:

(a) a pair of counter-rotatable casting rolls having casting surfaces with a center portion and edge portion, the center portion having surface roughness varied across the casting surface to correspond to a desired variation in metal shell thickness across the cast strip, and laterally positioned to form a gap at a nip between the casting surfaces of the casting rolls through which thin cast strip can be cast, (b) a metal delivery system adapted to deliver molten metal above the nip to form a casting pool supported on the casting surfaces of the casting rolls and confined at the edges of the casting rolls, and (c) a drive system adapted to counter-rotate the casting rolls forming metal shells on the casting surfaces of the casting rolls on the casting surfaces of the casting rolls that are brought together at the nip to deliver cast strip downwardly with varied thicknesses of the metal shells across the strip width.

The surface roughness of the center portion may be tapered across its width. For example, the taper of the surface roughness of the center portion across its width may be in stepped zones.

The surface roughness of the center portion may be tapered across its width with the middle part of the center portion at least 2 Ra below the surface roughness at outmost parts of the center portion. The edge portions may have an average surface roughness of between 5 and 7 Ra. Alternatively, the edge portions may have an average surface roughness of between 3 and 6 Ra. Alternatively or additionally, the surface roughness across each edge portion may be within 1.0 Ra.

In one alternative, the surface roughness of the center portion may be substantially similar across the width.

The surface roughness of the casting surface of the center portion of the casting rolls is varied in a range between 5 and 15 Ra. Alternatively, the surface roughness of the casting surface of the center portion of the casting rolls is varied in stepped zones in a range between 5 and 12 Ra. In one alternative, the casting rolls have a crown shape adapted to form a crown in the cast strip, and the crown shape of the casting roll surface of each casting roll is coordinated with variation in surface roughness across the center portion of the casting surface. The crown shape may be provided in stepped zones.

Additionally or alternatively, the surface roughness of the casting surface over the width of the casting rolls may be varied in a range between 5 and 15 Ra. The surface roughness of the casting surface over the width of the casting rolls may be varied in stepped zones in a range between 5 and 12 Ra. In one alternative, the casting rolls have a crown shape adapted to form a crown in the cast strip, and the crown shape of the casting roll surface of each casting roll is coordinated with variation in surface roughness across the width of the casting surface. The crown shape may be provided in stepped zones.

The surface roughness of the casting surface of the center portion of the casting rolls is varied to correspond to a desired variation in metal shell thickness formed for the cast strip.

The edge portion of each casting roll may be between 50 mm and 75 mm wide. Alternatively, the edge portion of each casting roll is between 25 mm and 75 mm wide.

The casting rolls may be between 450 and 650 mm in diameter.

The casting rolls may have a crown shape adapted to form a crown in the cast strip, and the crown shape of the casting roll surface of each casting roll is such that edge portions of the cast strip are of a higher temperature than the cast strip in the center portion of the strip width.

The as-cast thickness of the cast strip may be between about 0.6 and 2.4 millimeters, and the casting pool height may be between about 125 and 225 millimeters above the nip.

Also disclosed is a method of forming a surface roughness on a casting roll comprising (a) providing a texturing apparatus adapted to deliver a particulate media in a predetermined orientation against a casting roll surface, optionally using air pressure, (b) moving the texturing apparatus axially along the casting roll surface while rotating the casting roll, (c) varying one or more parameters from the group consisting of the rate of translation of the texturing apparatus, the rotational speed of the casting roll, the flow rate of particulate media, and, if present, the air pressure of the texturing apparatus, as the texturing apparatus translates axially along the casting roll surface (d) forming a surface roughness in the center portion of the casting rolls of at least 60% of the width of the casting rolls, two edge portions each of up to 7% of the width of the casting rolls, and at least one intermediate portion between each edge portion and the center portion, each edge portion having an average surface roughness between 3 and 7 Ra, the center portion having an average surface roughness between 1.2 and 4.0 times the surface roughness of the edge portions, and the intermediate portions having an average surface roughness between average surface roughness of the edge portions and the center portion.

The method may further comprise varying the nozzle angle and/or distance between texturing apparatus and casting surface as the texturing apparatus translates axially along the casting roll surface.

In one alternative, the rate of translation of the texturing apparatus axially along the casting roll may be varied between 0.25 and 4 inches per minute. The rotational speed of the casting roll may be varied between 10 and 20 revolutions per minute. The flow rate of particulate media may be varied between about 10 and 60 pounds per minute. The air pressure of the texturing apparatus may be varied between about 10 and 120 pounds per square inch.

The formed surface roughness of the center portion may be tapered across its width. For example, the taper of the surface roughness of the center portion across its width may be in stepped zones.

The surface roughness of the center portion may be tapered across its width with the middle part of the center portion at least 2 Ra below the surface roughness at outmost parts of the center portion. The edge portions may have an average surface roughness of between 5 and 7 Ra. Alternatively, the edge portions may have an average surface roughness of between 3 and 6 Ra. Alternatively or additionally, the surface roughness across each edge portion may be within 1.0 Ra.

In one alternative, the surface roughness of the center portion may be substantially similar across the width.

The surface roughness of the casting surface of the center portion of the casting rolls is varied in a range between 5 and 15 Ra. Alternatively, the surface roughness of the casting surface of the center portion of the casting rolls is varied in stepped zones in a range between 5 and 12 Ra. In one alternative, the casting rolls have a crown shape adapted to form a crown in the cast strip, and the crown shape of the casting roll surface of each casting roll is coordinated with variation in surface roughness across the center portion of the casting surface. The crown shape may be provided in stepped zones.

Additionally or alternatively, the surface roughness of the casting surface over the width of the casting rolls may be varied in a range between 5 and 15 Ra. The surface roughness of the casting surface over the width of the casting rolls may be varied in stepped zones in a range between 5 and 12 Ra. In one alternative, the casting rolls have a crown shape adapted to form a crown in the cast strip, and the crown shape of the casting roll surface of each casting roll is coordinated with variation in surface roughness across the width of the casting surface. The crown shape may be provided in stepped zones.

The surface roughness of the casting surface of the center portion of the casting rolls is varied to correspond to a desired variation in metal shell thickness formed for the cast strip.

The edge portion of each casting roll may be between 50 mm and 75 mm wide. Alternatively, the edge portion of each casting roll is between 25 mm and 75 mm wide.

The casting rolls may have a crown shape adapted to form a crown in the cast strip, and the crown shape of the casting roll surface of each casting roll is such that edge portions of the cast strip are of a higher temperature than the cast strip in the center portion of the strip width.

BRIEF DESCRIPTION OF THE DRAWINGS

The patent or application file contains at least one drawing executed in color. Copies of this patent or patent application publication with color drawings will be provided by the Patent and Trademark Office upon request and payment of necessary fee.

DETAILED DESCRIPTION OF THE DRAWINGS

Referring now to FIGS. 1 through 7, a twin roll caster is illustrated that comprises a main machine frame 10 that stands up from the factory floor and supports a pair of casting rolls mounted in a module in a roll cassette 11. The casting rolls 12 are mounted in the roll cassette 11 for ease of operation and movement as described below. The roll cassette facilitates rapid movement of the casting rolls ready for casting from a setup position into an operative casting position in the caster as a unit, and ready removal of the casting rolls from the casting position when the casting rolls are to be replaced. There is no particular configuration of the roll cassette that is desired, so long as it performs that function of facilitating movement and positioning of the casting rolls as described herein.

Figure 3:
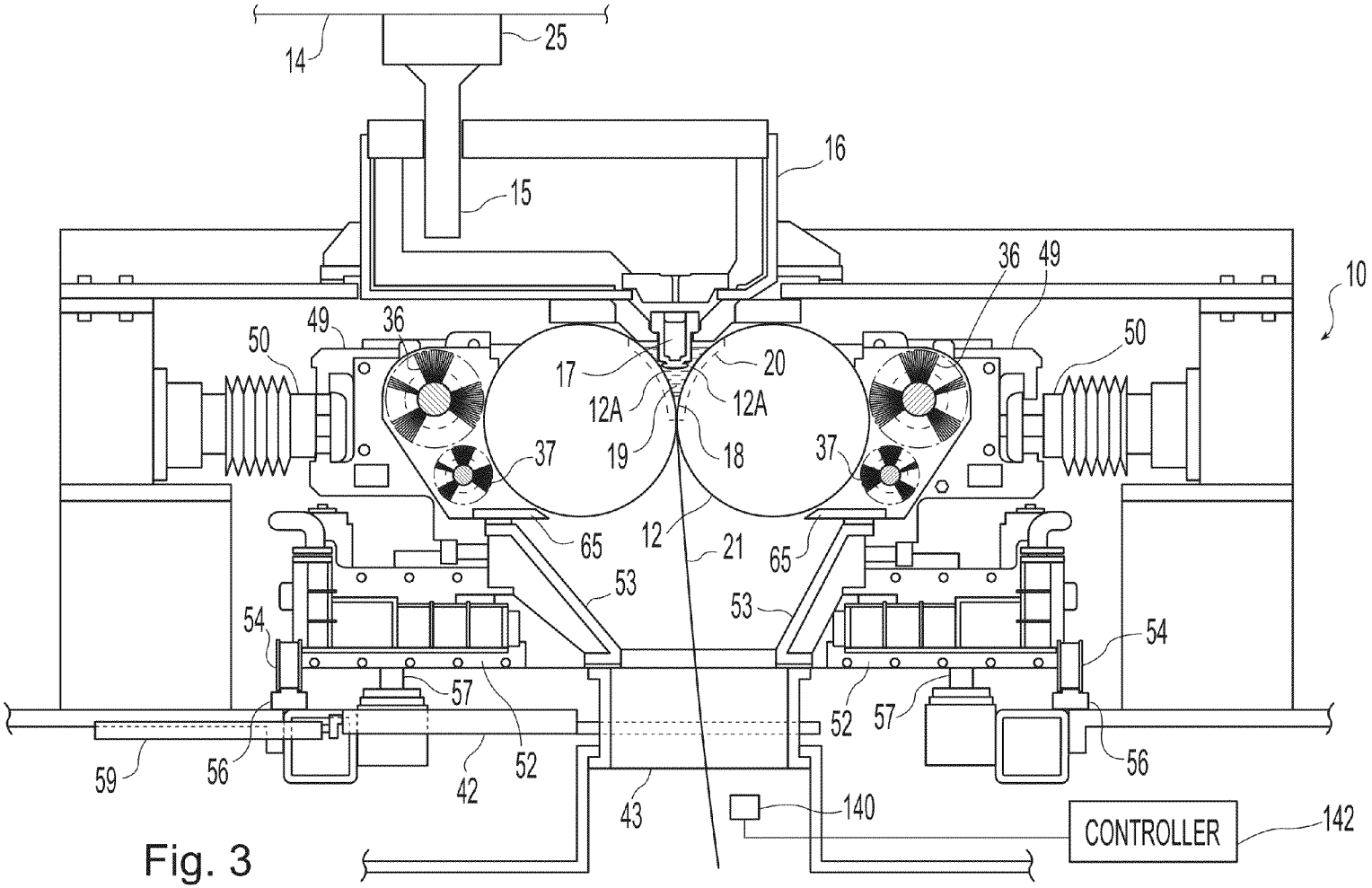
FIG. 3 is a partial sectional view through a pair of casting rolls mounted in a roll cassette of the present disclosure.

As shown in FIG. 3, the casting apparatus for continuously casting thin steel strip includes a pair of counter-rotatable casting rolls 12 having casting surfaces 12A laterally positioned to form a nip 18 there between. Molten metal is supplied from a ladle 13 through a metal delivery system to a metal delivery nozzle 17, or core nozzle, positioned between the casting rolls 12 above the nip 18. Molten metal thus delivered forms a casting pool 19 of molten metal above the nip supported on the casting surfaces 12A of the casting rolls 12. This casting pool 19 is confined in the casting area at the ends of the casting rolls 12 by a pair of side closures or side dam plates 20 (shown in dotted line in FIG. 3). The upper surface of the casting pool 19 (generally referred to as the "meniscus" level) may rise above the lower end of the delivery nozzle 17 so that the lower end of the delivery nozzle is immersed within the casting pool. The casting area includes the addition of a protective atmosphere above the casting pool 19 to inhibit oxidation of the molten metal in the casting area.

The delivery nozzle 17 is made of a refractory material such as alumina graphite. The delivery nozzle 17 may have a series flow passages adapted to produce a suitably low velocity discharge of molten metal along the rolls and to deliver the molten metal into the casting pool 19 without direct impingement on the roll surfaces. The side dam plates 20 are made of a strong refractory material and shaped to engage the ends of the rolls to form end closures for the molten pool of metal. The side dam plates 20 may be moveable by actuation of hydraulic cylinders or other actuators (not shown) to bring the side dams into engagement with the ends of the casting rolls.

Figure 1:
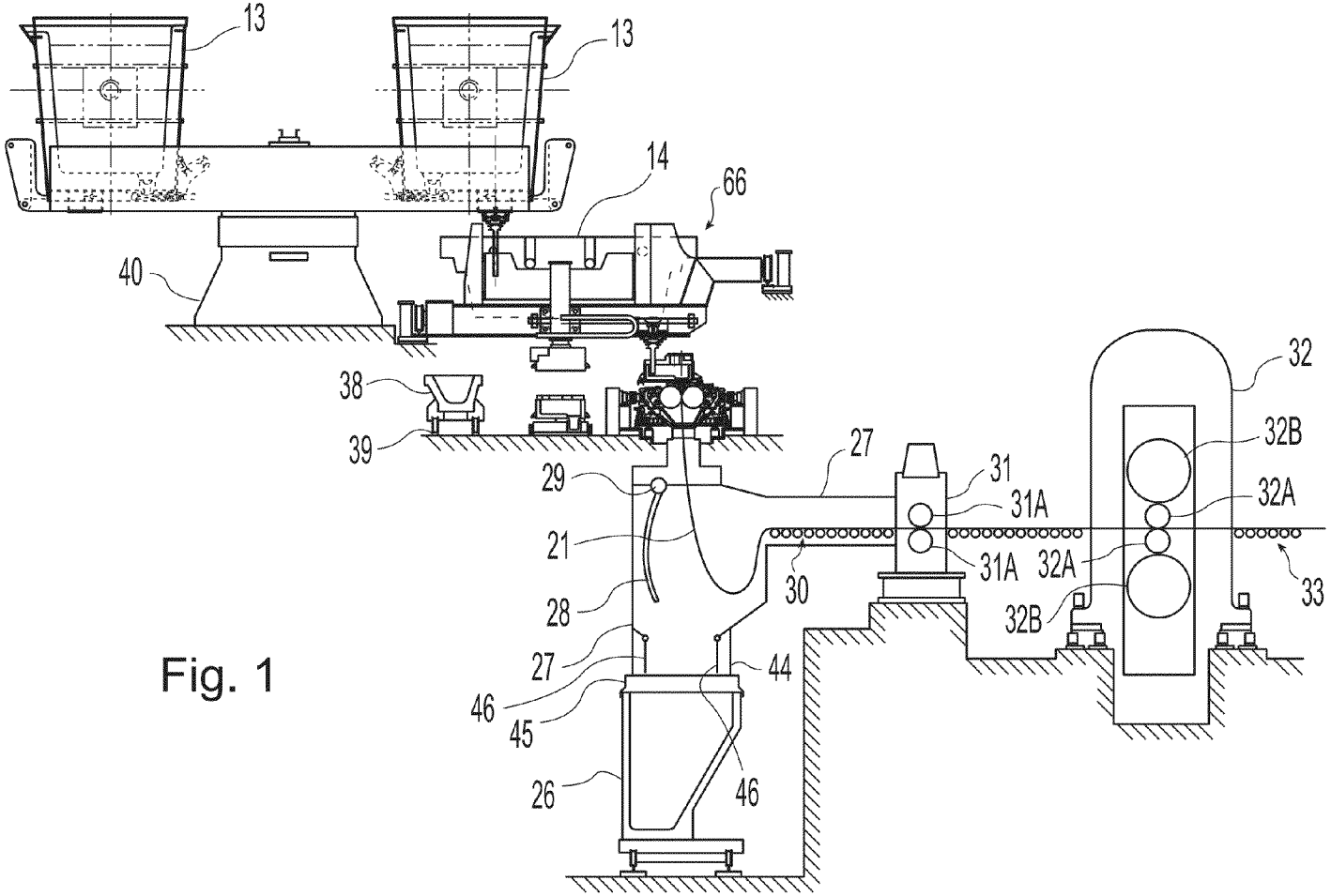
FIG. 1 is a diagrammatical side view of a twin roll caster of the present disclosure.
Figure 2:
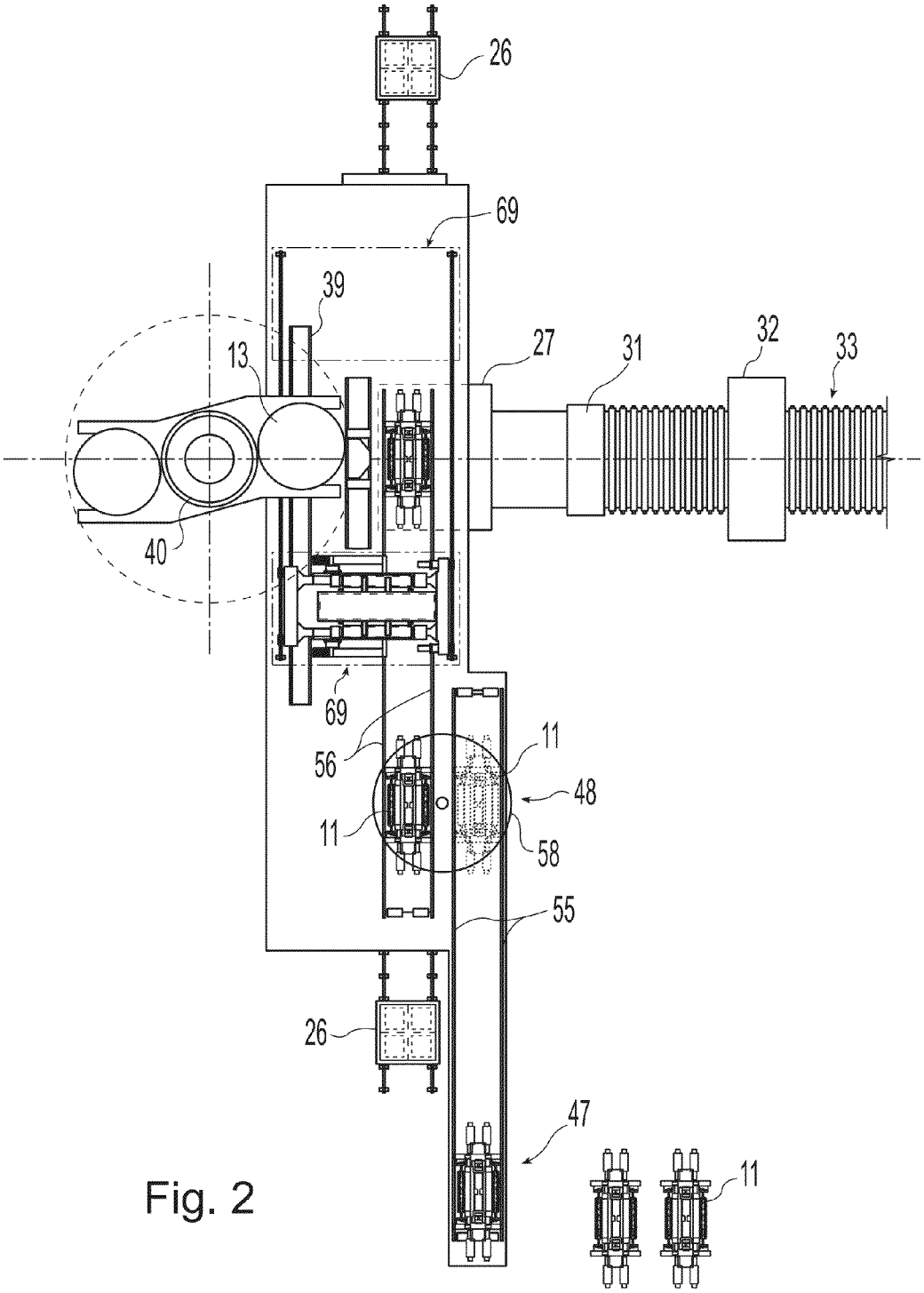
FIG. 2 is a diagrammatical plan view of the twin roll caster of FIG. 1.

Referring now to FIGS. 1 and 2, the ladle 13 typically is of a conventional construction supported on a rotating turret 40. For metal delivery, the ladle 13 is positioned over a movable tundish 14 in the casting position to fill the tundish with molten metal. The movable tundish 14 may be positioned on a tundish car 66 capable of transferring the tundish from a heating station 69, where the tundish is heated to near a casting temperature, to the casting position. A tundish guide positioned beneath the tundish car 66 to enable moving the movable tundish 14 from the heating station 69 to the casting position.

The tundish car 66 may include a frame adapted to raising and lowering the tundish 14 on the tundish car 66. The tundish car 66 may move between the casting position to a heating station at an elevation above the casting rolls 12 mounted in roll cassette 11, and at least a portion of the tundish guide may be overhead from the elevation of the casting rolls 12 mounted on roll cassette 11 for movement of the tundish between the heating station and the casting position.

The movable tundish 14 may be fitted with a slide gate 25, actuable by a servo mechanism, to allow molten metal to flow from the tundish 14 through the slide gate 25, and then through a refractory outlet shroud 15 to a transition piece or distributor 16 in the casting position. The distributor 16 is made of a refractory material such as, for example, magnesium oxide (MgO). From the distributor 16, the molten metal flows to the delivery nozzle 17 positioned between the casting rolls 12 above the nip 18.

The casting rolls 12 are internally water cooled so that as the casting rolls 12 are counter-rotated, shells solidify on the casting surfaces 12A as the casting surfaces move into contact with and through the casting pool 19 with each revolution of the casting rolls 12. The shells are brought together at the nip 18 between the casting rolls to produce a solidified thin cast strip product 21 delivered downwardly from the nip. FIG. 1 shows the twin roll caster producing the thin cast strip 21, which passes across a guide table 30 to a pinch roll stand 31, comprising pinch rolls 31A. Upon exiting the pinch roll stand 31, the thin cast strip may pass through a hot rolling mill 32, comprising a pair of reduction rolls 32A and backing rolls 32B, where the cast strip is hot rolled to reduce the strip to a desired thickness, improve the strip surface, and improve the strip flatness. The rolled strip then passes onto a run-out table 33, where it may be cooled by contact with water supplied via water jets or other suitable means, not shown, and by convection and radiation. In any event, the rolled strip may then pass through a second pinch roll stand (not shown) to provide tension of the strip, and then to a coiler.

At the start of the casting operation, a short length of imperfect strip is typically produced as casting conditions stabilize. After continuous casting is established, the casting rolls are moved apart slightly and then brought together again to cause this leading end of the strip to break away forming a clean head end of the following cast strip. The imperfect material drops into a scrap receptacle 26, which is movable on a scrap receptacle guide. The scrap receptacle 26 is located in a scrap receiving position beneath the caster and forms part of a sealed enclosure 27 as described below. The enclosure 27 is typically water cooled. At this time, a water-cooled apron 28 that normally hangs downwardly from a pivot 29 to one side in the enclosure 27 is swung into position to guide the clean end of the cast strip 21 onto the guide table 30 that feeds it to the pinch roll stand 31. The apron 28 is then retracted back to its hanging position to allow the cast strip 21 to hang in a loop beneath the casting rolls in enclosure 27 before it passes to the guide table 30 where it engages a succession of guide rollers.

An overflow container 38 may be provided beneath the movable tundish 14 to receive molten material that may spill from the tundish. As shown in FIGS. 1 and 2, the overflow container 38 may be movable on rails 39 or another guide such that the overflow container 38 may be placed beneath the movable tundish 14 as desired in casting locations. Additionally, an overflow container may be provided for the distributor 16 adjacent the distributor (not shown).

The sealed enclosure 27 is formed by a number of separate wall sections that fit together at various seal connections to form a continuous enclosure wall that permits control of the atmosphere within the enclosure. Additionally, the scrap receptacle 26 may be capable of attaching with the enclosure 27 so that the enclosure is capable of supporting a protective atmosphere immediately beneath the casting rolls 12 in the casting position. The enclosure 27 includes an opening in the lower portion of the enclosure, lower enclosure portion 44, providing an outlet for scrap to pass from the enclosure 27 into the scrap receptacle 26 in the scrap receiving position. The lower enclosure portion 44 may extend downwardly as a part of the enclosure 27, the opening being positioned above the scrap receptacle 26 in the scrap receiving position. As used in the specification and claims herein, "seal", "sealed", "sealing", and "sealingly" in reference to the scrap receptacle 26, enclosure 27, and related features may not be a complete seal so as to prevent leakage, but rather is usually less than a perfect seal as appropriate to allow control and support of the atmosphere within the enclosure as desired with some tolerable leakage.

A rim portion 45 may surround the opening of the lower enclosure portion 44 and may be movably positioned above the scrap receptacle, capable of sealingly engaging and/or attaching to the scrap receptacle 26 in the scrap receiving position. The rim portion 45 is in selective engagement with the upper edges of the scrap receptacle 26, which is illustratively in a rectangular form, so that the scrap receptacle may be in sealing engagement with the enclosure 27 and movable away from or otherwise disengageable from the scrap receptacle as desired.

Figure 4:
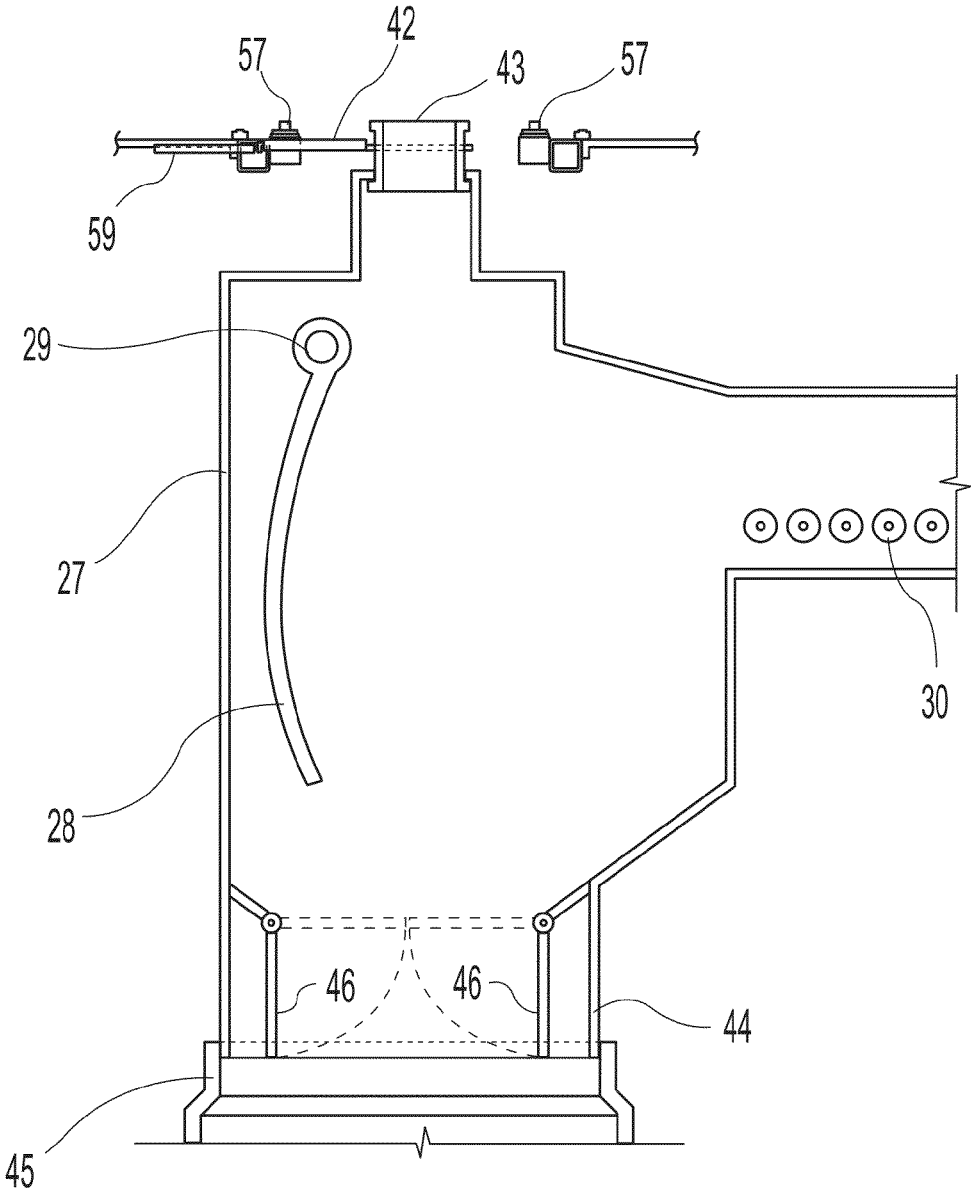
FIG. 4 is a diagrammatical side view of the enclosure of the caster beneath the casting rolls.

A lower plate 46 may be operatively positioned within or adjacent the lower enclosure portion 44 to permit further control of the atmosphere within the enclosure when the scrap receptacle 26 is moved from the scrap receiving position and provide an opportunity to continue casting while the scrap receptacle is being changed for another. The lower plate 46 may be operatively positioned within the enclosure 27 adapted to closing the opening of the lower portion of the enclosure, or lower enclosure portion 44, when the rim portion 45 is disengaged from the scrap receptacle. Then, the lower plate 46 may be retracted when the rim portion 45 sealingly engages the scrap receptacle to enable scrap material to pass downwardly through the enclosure 27 into the scrap receptacle 26. The lower plate 46 may be in two plate portions as shown in FIGS. 1 and 4, pivotably mounted to move between a retracted position and a closed position, or may be one plate portion as desired. A plurality of actuators (not shown) such as servo-mechanisms, hydraulic mechanisms, pneumatic mechanisms and rotating actuators may be suitably positioned outside of the enclosure 27 adapted to moving the lower plate in whatever configuration between a closed position and a retracted position. When sealed, the enclosure 27 and scrap receptacle 26 are filled with a desired gas, such as nitrogen, to reduce the amount of oxygen in the enclosure and provide a protective atmosphere for the cast strip.

The enclosure 27 may include an upper collar portion 43 supporting a protective atmosphere immediately beneath the casting rolls in the casting position. The upper collar portion 43 may be moved between an extended position adapted to supporting the protective atmosphere immediately beneath the casting rolls and an open position enabling an upper cover 42 to cover the upper portion of the enclosure 27. When the roll cassette 11 is in the casting position, the upper collar portion 43 is moved to the extended position closing the space between a housing portion 53 adjacent the casting rolls 12, as shown in FIG. 3, and the enclosure 27 by one or a plurality of actuators (not shown) such as servo-mechanisms, hydraulic mechanisms, pneumatic mechanisms, and rotating actuators. The upper collar portion 43 may be water cooled.

The upper cover 42 may be operably positioned within or adjacent the upper portion of the enclosure 27 capable of moving between a closed position covering the enclosure and a retracted position enabling cast strip to be cast downwardly from the nip into the enclosure 27 by one or more actuators 59, such as servo-mechanisms, hydraulic mechanisms, pneumatic mechanisms, and rotating actuators. When the upper cover 42 is in the closed position, the roll cassette 11 may be moved from the casting position without significant loss of the protective atmosphere in the enclosure. This enables a rapid exchange of casting rolls, with the roll cassette, since closing the upper cover 42 enables the protective atmosphere in the enclosure to be preserved so that it does not have to be replaced.

The casting rolls 12 mounted in roll cassette 11 are capable of being transferred from a set up station 47 to a casting position through a transfer station 48, as shown in FIG. 2. The casting rolls 12 may be assembled into the roll cassette 11 and then moved to the set up station 47, where at the set up station the casting rolls mounted in the roll cassette may be prepared for casting. At the transfer station 48, casting rolls mounted in roll cassettes may be exchanged, and in the casting position the casting rolls mounted in the roll cassette are operational in the caster. A casting roll guide is adapted to enable the transfer of the casting rolls mounted in the roll cassette between the set up station and the transfer station, and between the transfer station and the casting position. The casting roll guides may comprise rails on which the casting rolls 12 mounted in the roll cassette 11 are capable of being moved between the set up station and the casting position through the transfer station. Rails 55 may extend between the set up station 47 to the transfer station 48, and rails 56 may extend between the transfer station 48 to the casting position. The casting rolls mounted in a roll cassette may be raised or lowered into the casting position.

In one embodiment, the roll cassette 11 may include wheels 54 capable of supporting and moving the roll cassette on the rails 55, 56.

As shown in FIG. 2, the transfer station 48 may include a turntable 58. The rails 55, 56 may be capable of being aligned with rails on the turntable 58 of the transfer station such that the turntable 58 may be turned to exchange casting rolls mounted in roll cassettes between the first rails 55 and the second rails 56. The turntable 58 may rotate about a center axis to transfer a roll cassette from one set of rails to another.

The roll cassette 11 with casting rolls may be assembled in a module for rapid installation in the caster in preparation for casting strip, and for rapid set up of the casting rolls 12 for installation. The roll cassette 11 comprises a cassette frame 52, roll chocks 49 capable of supporting the casting rolls 12 and moving the casting rolls on the cassette frame, and the housing portion 53 positioned beneath the casting rolls capable of supporting a protective atmosphere in the enclosure 27 immediately beneath the casting rolls during casting. The cassette frame 52 may include linear bearings and/or other guides adapted to assist movement of the casting rolls toward and away from one another. The housing portion 53 is positioned corresponding to and sealingly engaging an upper portion of the enclosure 27 for enclosing the cast strip below the nip.

Figure 9:
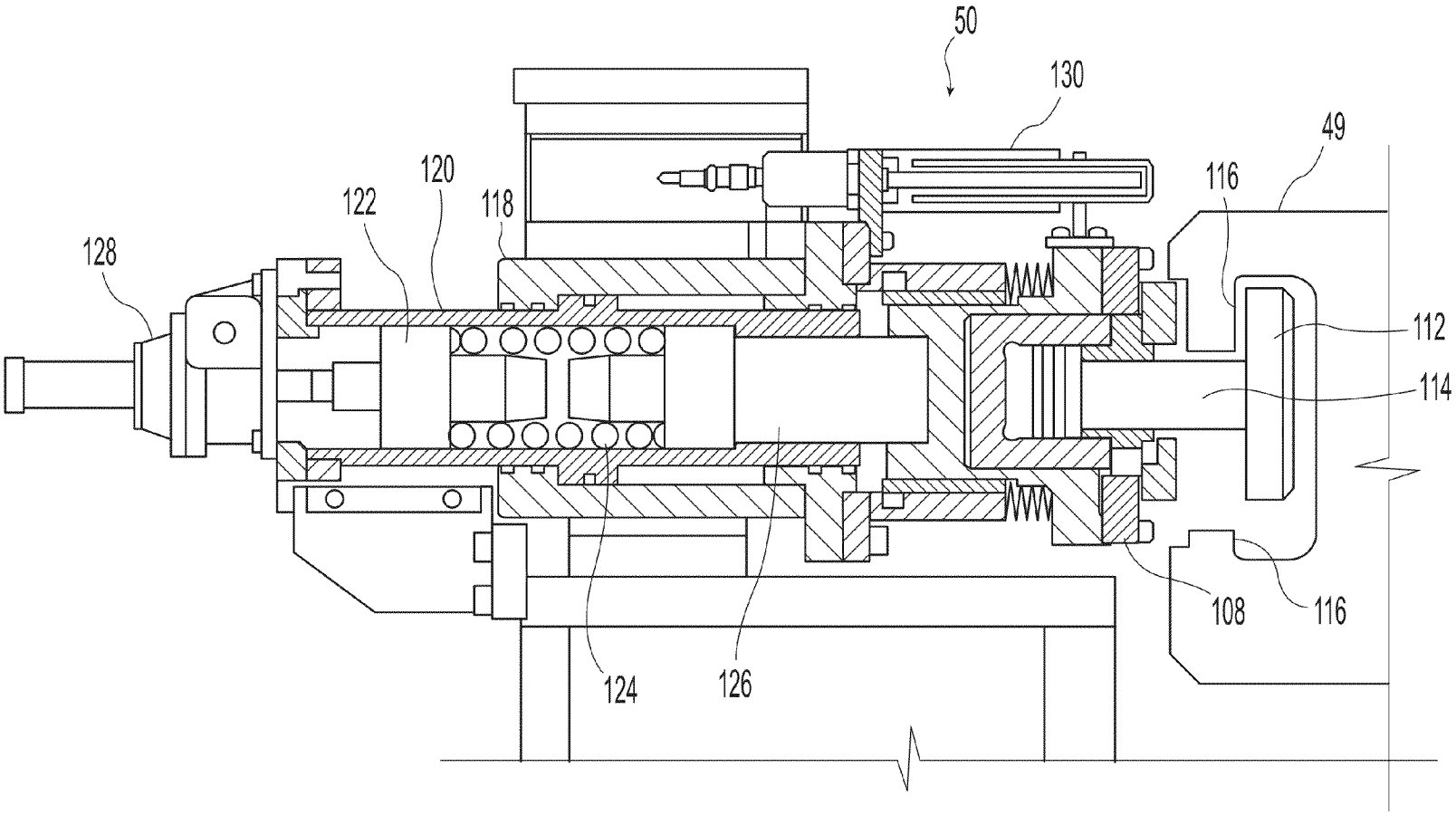
FIG. 9 is a sectional view through a positioning assembly in the retracted position of FIG. 7.

A roll chock positioning system is provided on the main machine frame 10 having two pairs of positioning assemblies 50 that can be rapidly connected to the roll cassette adapted to enable movement of the casting rolls on the cassette frame 52, and provide forces resisting separation of the casting rolls during casting. The positioning assemblies 50 may include a compression spring provided to control one of the casting rolls as discussed below. As shown in FIG. 9, the positioning assembly 50 has a flange 112 capable of engaging the roll cassette 11. The positioning assembly 50 may be secured to the roll cassette by a flange cylinder 114. The flange cylinder 114 is engaged to secure the flange 112 against a corresponding surface 116 of the roll cassette 11. Alternatively, the positioning assemblies 50 may include actuators such as mechanical roll biasing units or servo-mechanisms, hydraulic or pneumatic cylinders or mechanisms, linear actuators, rotating actuators, magnetostrictive actuators or other devices for enabling movement of the casting rolls and resisting separation of the casting rolls during casting. In one alternative, the positioning assemblies 50 may include positioning actuators such as disclosed in U.S. Pat. No. 8,002,016 filed Mar. 16, 2009.

Figure 8:
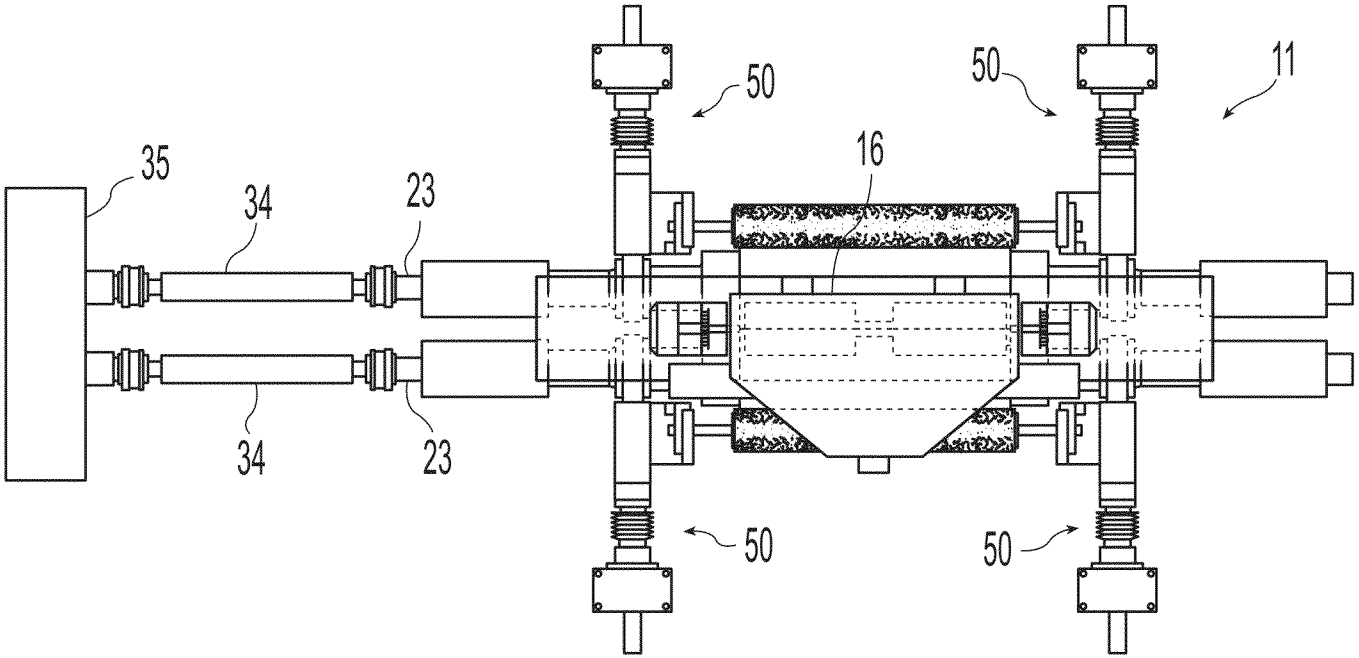
FIG. 8 is a diagrammatical plan view of the roll cassette with the roll cassette in a casting position.

The casting rolls 12 include shaft portions 22, which are connected to drive shafts 34, best viewed in FIG. 8, through end couplings 23. The casting rolls 12 are counter-rotated through the drive shafts by an electric motor (not shown) and transmission 35 mounted on the main machine frame. The drive shafts can be disconnected from the end couplings 23 when the cassette is to be removed enabling the casting rolls to be changed without dismantling the actuators of the positioning assemblies 50. The casting rolls 12 have copper peripheral walls formed with an internal series of longitudinally extending and circumferentially spaced water cooling passages, supplied with cooling water through the roll ends from water supply ducts in the shaft portions 22, which are connected to water supply hoses 24 through rotary joints (not shown). The casting rolls 12 may be between about 450 and 650 millimeters. Alternatively, the casting rolls 12 may be up to 1200 millimeters or more in diameter. The length of the casting rolls 12 may be up to about 2000 millimeters, or longer, in order to enable production of strip product of about 2000 millimeters width, or wider, as desired in order to produce strip product approximately the width of the rolls. Additionally, at least a portion of the casting surfaces may be textured with a distribution of discrete projections, for example, random discrete projections as described and claimed in U.S. Pat. No. 7,073,565 and having the tapered distribution of surface roughness described herein. The casting surface may be coated with chrome, nickel, or other coating material to protect the texture.

Figure 5:
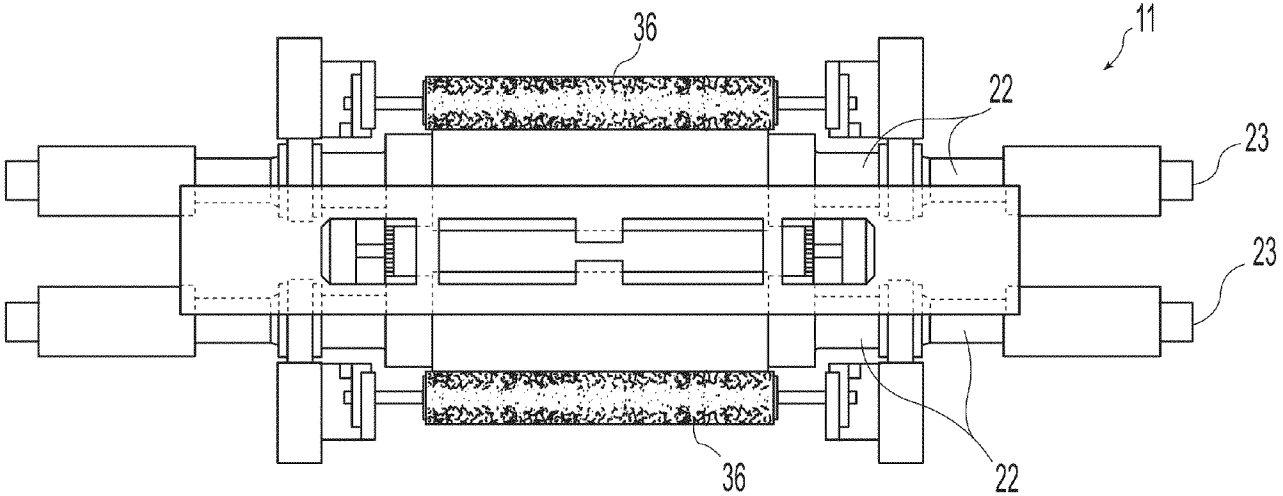
FIG. 5 is a diagrammatical plan view of the roll cassette of FIG. 3 with the rolls removed from the roll cassette.
Figure 6:
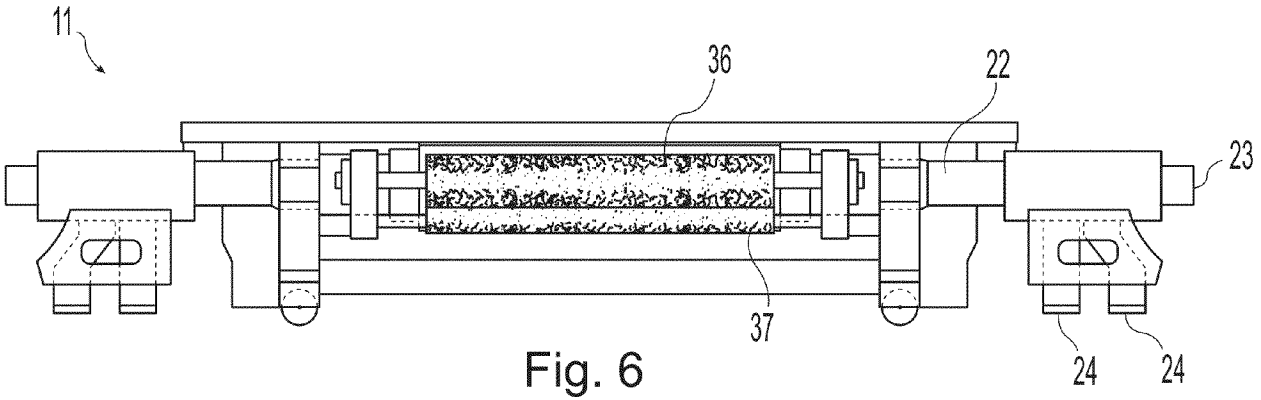
FIG. 6 is a diagrammatical side view of the roll cassette of FIG. 3 with the rolls removed from the roll cassette.
Figure 7:
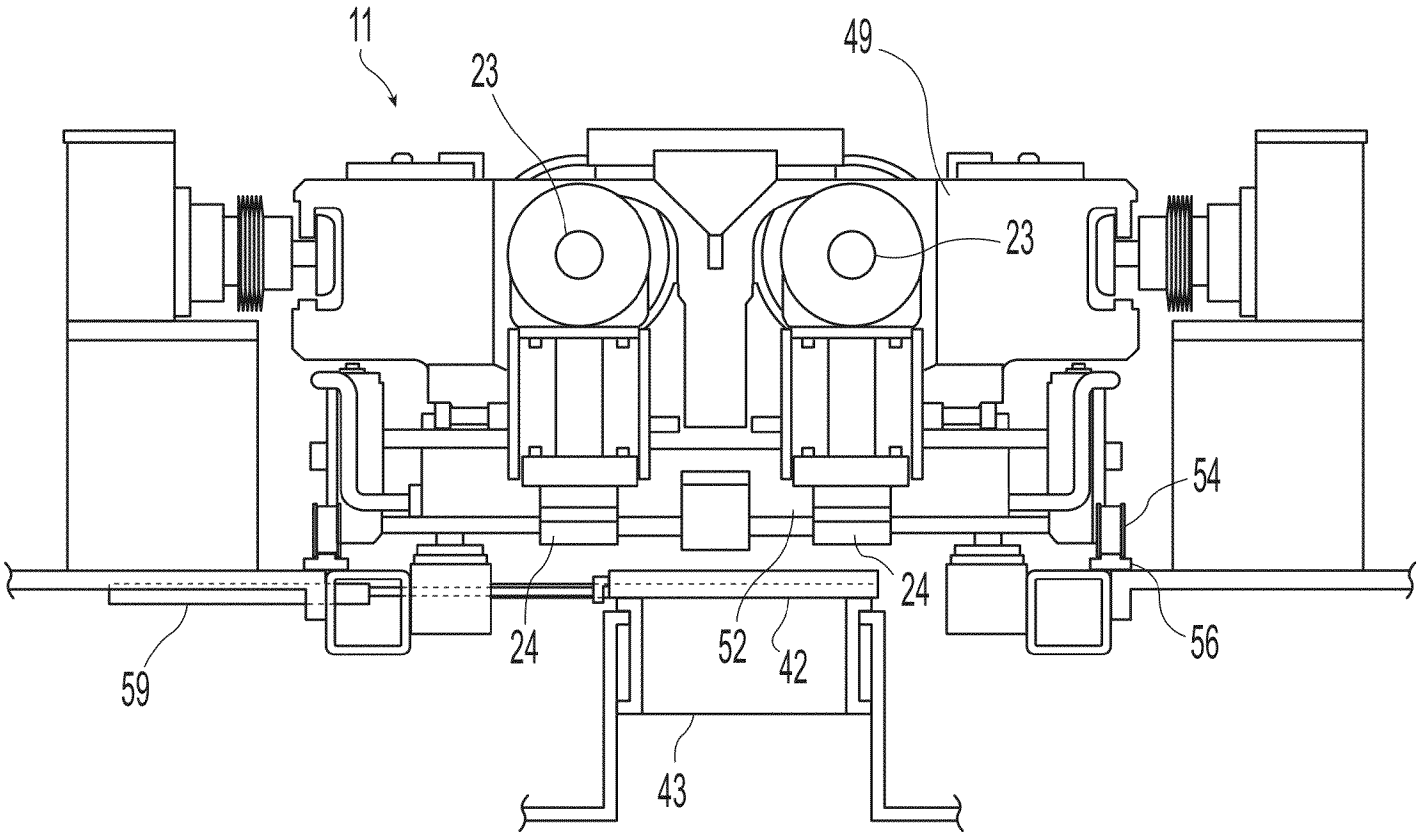
FIG. 7 is a diagrammatical end view of the roll cassette in the casting position.

As shown in FIGS. 3 and 5, cleaning brushes 36 are disposed adjacent the pair of casting rolls, such that the periphery of the cleaning brushes 36 may be brought into contact with the casting surfaces 12A of the casting rolls 12 to clean oxides from the casting surfaces during casting. The cleaning brushes 36 are positioned at opposite sides of the casting area adjacent the casting rolls, between the nip 18 and the casting area where the casting rolls enter the protective atmosphere in contact with the molten metal casting pool 19. Optionally, a separate sweeper brush 37 may be provided for further cleaning the casting surfaces 12A of the casting rolls 12, for example at the beginning and end of a casting campaign as desired.

A knife seal 65 may be provided adjacent each casting roll 12 and adjoining the housing portion 53. The knife seals 65 may be positioned as desired near the casting roll and form a partial closure between the housing portion 53 and the rotating casting rolls 12. The knife seals 65 enable control of the atmosphere around the brushes, and reduce the passage of hot gases from the enclosure 27 around the casting rolls. The position of each knife seal 65 may be adjustable during casting by causing actuators such as hydraulic or pneumatic cylinders to move the knife seal toward or away from the casting rolls.

Once the roll cassette 11 is in the operating position, the casting rolls are secured with the positioning assemblies 50 connected to the roll cassette 11, drive shafts connected to the end couplings 23, and a supply of cooling water coupled to water supply hoses 24. A plurality of jacks 57 may be used to further place the casting rolls in operating position. The jacks 57 may raise, lower, or laterally move the roll cassette 11 in the casting position as desired. The positioning assemblies 50 move one of the casting rolls 12 toward or away from the other casting roll, typically maintained against an adjustable stop, to provide a desired nip, or gap between the rolls in the casting position.

To control the gap between the rolls and control the casting of the strip product, one of the casting rolls 12 is typically mounted in the roll cassette 11 adapted to moving toward and away from the other casting roll 12 during casting. The positioning assemblies 50 include an actuator capable of moving laterally the casting roll toward and away from the other casting roll as desired. Temperature sensors 140 are provided adapted to sensing the temperature of the cast strip downstream from the nip at a reference location and producing a sensor signal corresponding to the temperature of the cast strip below the nip. A control system or controller 142 is provided adapted to control the actuators to vary the gap between the casting rolls to provide a controlled amount of mushy material between the metal shells of the cast strip at the nip in response to the sensor signal received from the sensor and processed to determine the temperature difference between the sensed temperature profile and a target temperature profile at a desired location downstream of the nip.

As shown in FIG. 9, the positioning assembly 50 may include an actuator 118 capable of moving a thrust element 120 in connection with the flange 112. Optionally, a force sensor or load cell 108 may be positioned between the thrust element 120 and the flange 112. The load cell 108 is positioned capable of sensing forces urging the casting roll 12 against the thin cast strip casting between the casting rolls 12 indicative of the sensed force exerted on the strip adjacent the nip. Positioning assembly 50 may include an additional load cell capable of measuring the spring compression force.

The thrust element 120 for the positioning assembly 50 may include a spring positioning device 122, a compression spring 124 having a desired spring rate, and a slidable shaft 126 movable against the compression spring 124 within the thrust element 120. A screw jack 128 or other linear actuator may be provided capable of translating the spring positioning device 122, and thereby advancing the slidable shaft 126 and compressing the compression spring 124. The flange 112 is connected to the slidable shaft 126 and displaceable against the compression spring 124.

A location sensor 130 may be provided with positioning assembly 50 to determine the location of the slidable shaft 126, and thereby the position of the flange 112 and the roll chock 49 secured thereto. The position sensor 130 provides signals to the controller 142 indicating the position of the roll chock 49 and associated casting roll 12 to determine the gap between the casting rolls at the nip.

Figure 11:
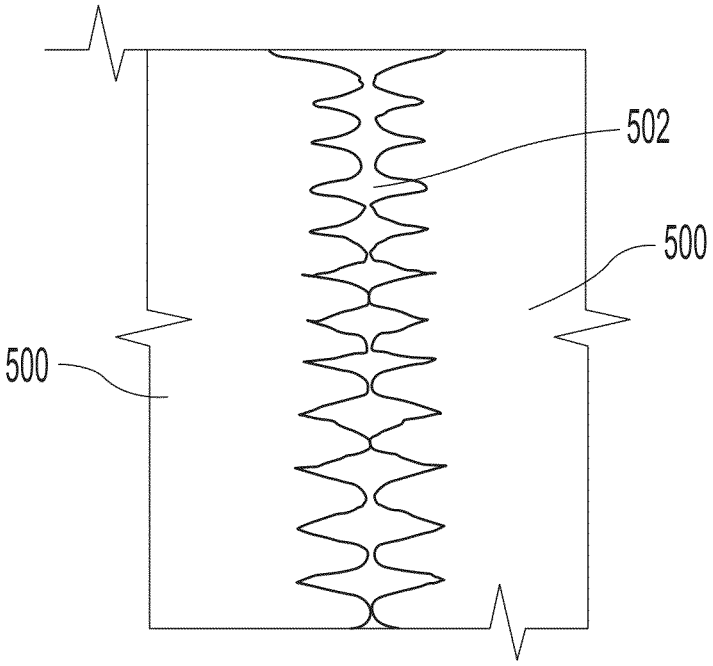
FIG. 11 is a illustrative cross-sectional view of cast strip below the nip.

The casting rolls 12 are internally water cooled so that as the casting rolls 12 are counter-rotated, shells solidify on the casting surfaces 12A as the casting surfaces rotate into contact with and through the casting pool 19. During casting, metal shells formed on the casting surfaces of the casting rolls are brought together at the nip to deliver cast strip downwardly with a controlled amount of mushy material between the metal shells. As illustrated in FIG. 11, mushy material 502 may be swallowed between the metal shells 500. The mushy material 502 between the shells in the strip cast downwardly from the nip may include molten metal and partially solidified metal. The amount of mushy material between the metal shells may be controlled by increasing or decreasing the gap between the casting rolls, and more importantly, varying the shell thickness by controlling the surface roughness across the casting surface 12A of the casting rolls 12 (as described herein) to provide controlled shell thickness and mushy material in the center portions of the cast strip.

Figure 19:
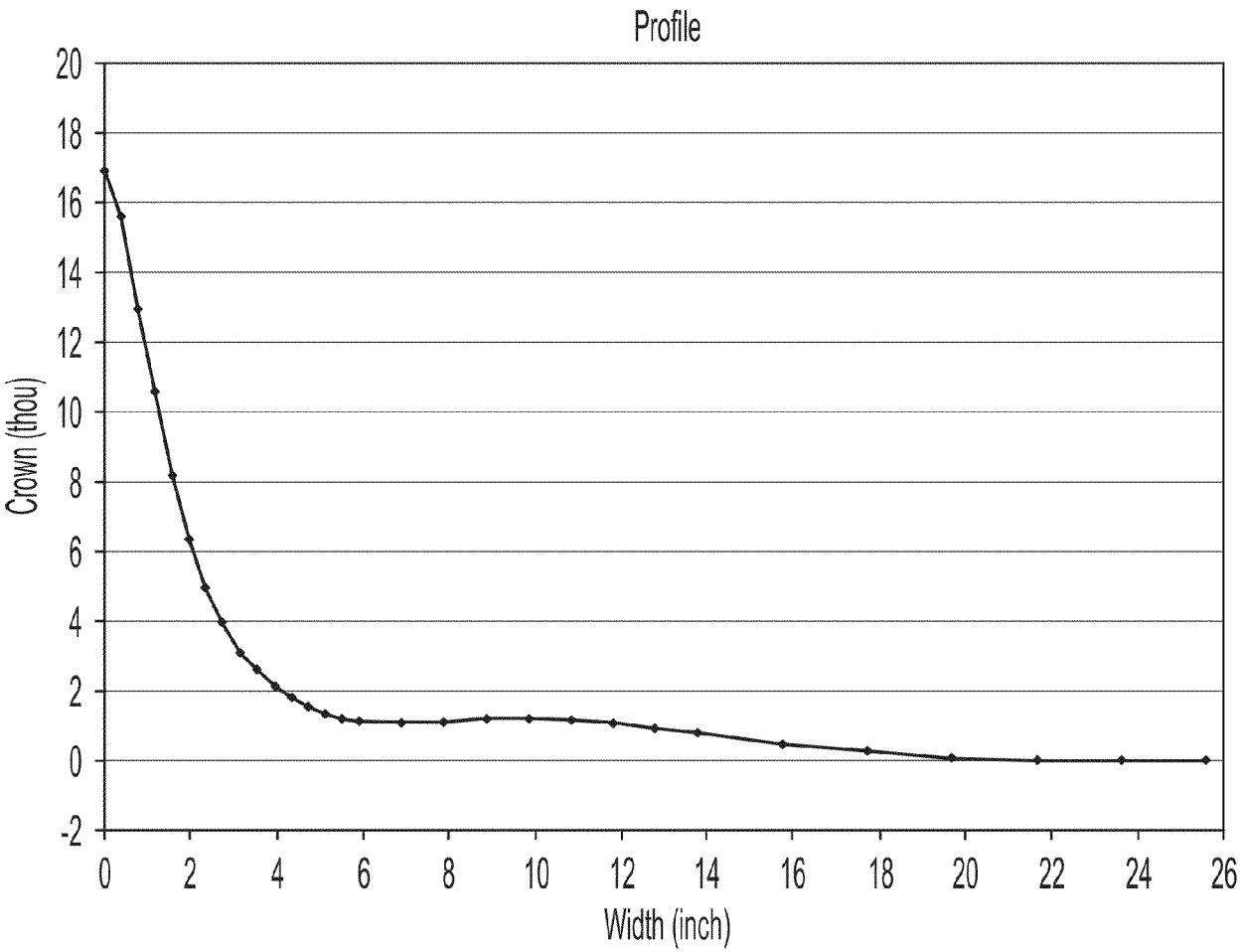
FIG. 19 is a graph illustrating the amount of crown in one example of a casting roll showing larger casting roll radius at the edge decreasing toward the center of the roll.

The casting surfaces 12A of casting rolls 12 are machined with an initial crown shape to allow for thermal expansion when the rolls are in use. In one example shown by the graph of FIG. 19, the casting roll may have about 0.017 inch larger casting roll radius at the edge of the cold casting roll than at the center of the casting roll, the center of the roll being 0.0 inch crown in FIG. 19. When the casting roll is in use during casting, thermal expansion decreases the amount of crown in the roll, typically such that the strip cast between the casting rolls has a crown, for example, between 10 and 100 micrometers thicker in the center portion of the strip width than adjacent edge portions of the strip width. The same degree of concave crown shape in the casting roll is provided in both the copper sleeve of the casting roll defining the outer periphery of the roll surface, and in the plating layer of chrome, nickel, or other coating material provided over the copper sleeve. The concave crown in the casting rolls may be selected to maintain a desired crown in the cast strip accounting for the thermal expansion of the casting rolls during casting, and at the same time, provide mushy material between the shells of the cast strip during casting.

Figure 10:
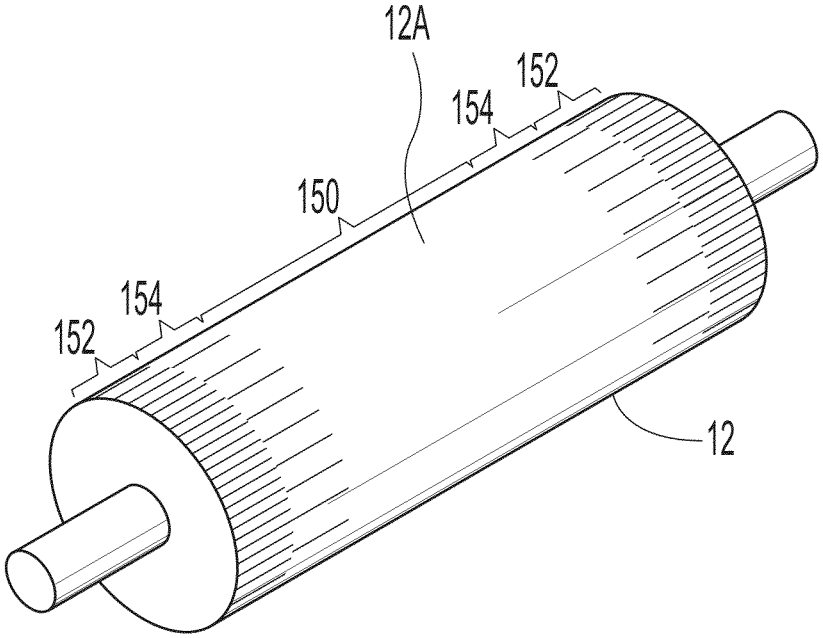
FIG. 10 is a diagrammatical perspective view of a casting roll.

The casting rolls each have casting surfaces 12A with a center portion 150 at least 60% of the width of the casting roll 12, edge portions 152 each less than 7% of the width of the casting roll 12, and intermediate portions 154 between each edge portion and the center portion as shown in FIG. 10. The edge portions may be textured to provide a desired heat flux and adapted to provide edges of the strip with a controlled amount of mushy material as disclosed in U.S. Pat. No. 8,141,618, filed Jun. 24, 2008. The crown shape of the casting roll surface 12A of each casting roll 12 is such that edge portions 152 of the cast strip are of a higher temperature than the cast strip in the center portion 150 of the strip width. In one alternative, the heat flux density may be between about 7 to 15 megawatts per square meter through the casting roll surfaces.

Figure 12:
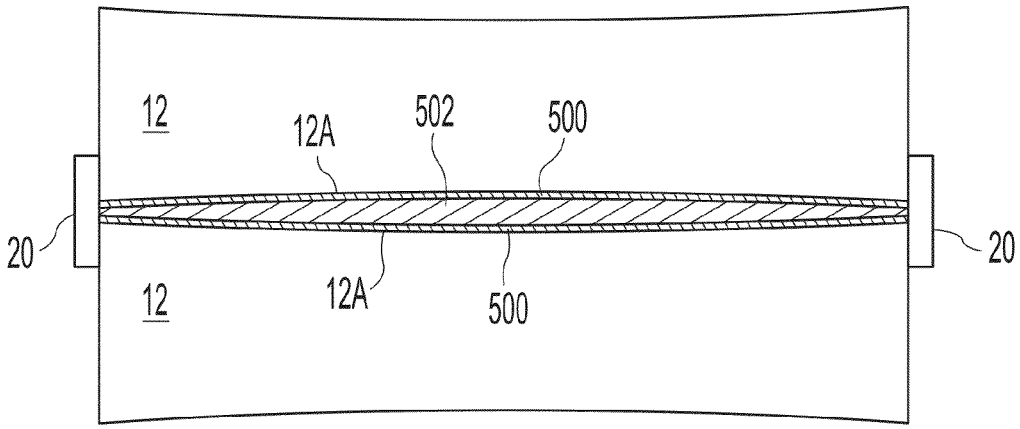
Fig. 12 (Prior Art)
FIG. 12 is a diagrammatical sectional view through a pair of casting rolls at the nip.

As discussed above, with prior casting rolls, reheating has a tendency to weaken the shells in the center portion 150 of the strip because of the presence of more mushy material. FIG. 12 provides a diagrammatical illustration of the increased amount of mushy material in the center portion of prior casting rolls. The variable amount of mushy material has contributed to temperature rebound and ridges in the cast strip. However, the roughness across the center portion can be controlled for the shells to come together. With the control of the surface roughness across the casting roll surfaces thicker shells can be formed in the center portion 150 of the strip, such that less mushy material is present in the center portion of the strip as shown in the diagrammatical illustration in FIG. 13.

Figure 13:
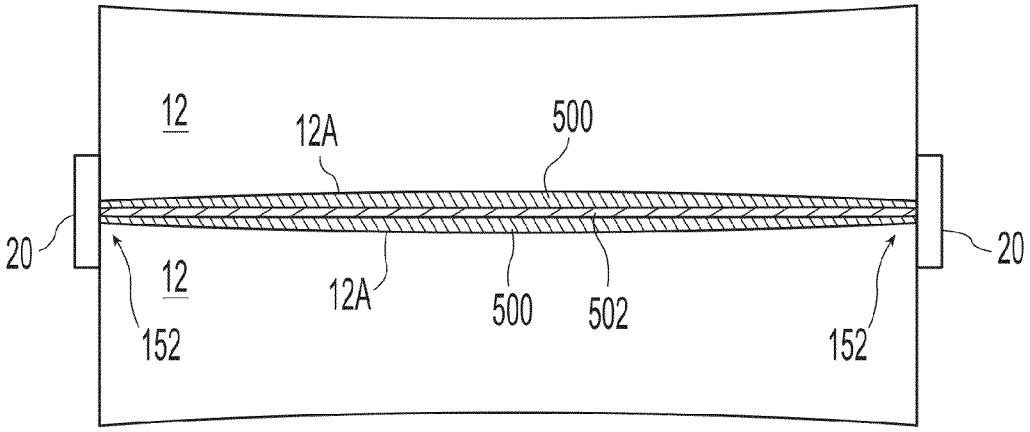
FIG. 13 is a diagrammatical sectional view through an alternative pair of casting rolls of the present disclosure at the nip.

We have found that the shell thickness may be varied across the casting roll width to provide a more even amount of mushy material between the shells across the strip width as shown in the diagrammatical view in FIG. 13. The center portion of each casting roll has surface roughness varied across the casting surface to correspond to a desired variation in metal shell thickness formed for the cast strip. For example, the surface roughness may be varied across the casting surface to maintain a shell thickness to provide mushy material less than 100 micrometers thickness along the strip width below the nip as discussed below with reference to FIG. 14. Alternatively, the surface roughness may be varied across the casting surface to maintain a shell thickness to provide mushy material less than 50 micrometers thickness along the strip width below the nip.

To provide a variable shell thickness across the casting roll, each edge portion 152 of the casting rolls may have an average surface roughness between 3 and 7 Ra and the center portion 150 having average surface roughness between 1.2 and 4.0 times the surface roughness of the edge portions. The intermediate portions may have an average surface roughness between the average surface roughness of the edge portions and the average surface roughness of the center portion. Alternatively or additionally, the intermediate portions 154 may have an average surface roughness between about 4 and 12 Ra. The intermediate portions 154 may provide a transition from the surface roughness of the edge portions 152 to the surface roughness of the center portion 150.

The surface roughness of the casting surface 12A of the casting rolls 12 or of the center portion 150 of the casting rolls 12 may be varied in a desired range selected between 5 and 15 Ra. Alternatively, the surface roughness of the casting surface 12A of the casting rolls 12 or of the center portion 150 of the casting rolls 12 may be varied in a desired range selected between 5 and 12 Ra. For example, as shown by the example in FIG. 18, the average surface roughness may vary between 9 and 13 Ra across the center portion 150 of the casting surface 12A. By varying the surface roughness of the casting surface 12A, the heat flux through the casting surface may be varied accordingly to control the shell thickness across the width as desired to control ridges in the cast strip.

Figures 17, 18:
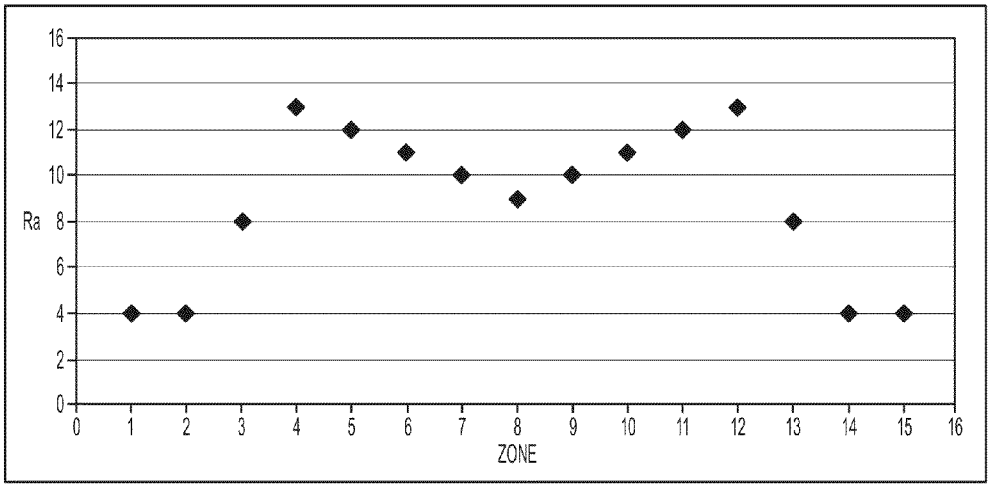
FIG. 17 is a table of texturing parameters used to form a tapered surface roughness on a casting roll in one example of the present disclosure.
FIG. 18 is a graph of a tapered surface roughness along one example of a casting roll of the present disclosure.

In one example tabulated in FIG. 17, the center portion 150 of the casting roll is divided into a plurality of roughness zones, each zone having a different average surface roughness providing the tapered surface roughness of the cast surface in a stepped zone. As shown in FIG. 18, the surface roughness of the center portion 150 may be tapered across the width of the center portion such that the surface roughness decreases from the outermost parts of the center portion 150 toward the middle of the center portion in a stepped zone or continuous taper. Alternatively, the surface roughness may be tapered continuously along the casting roll. In another alternative, the surface roughness of the center portion 150 may be substantially similar across the width.

The crown shape of the casting roll surface of each casting roll is coordinated with variation in surface roughness across the center portion 150 of the casting surface. Stated another way, the roll crown shape and variation of the surface roughness are each selected to provide desired thickness and thickness variation of the shells and mushy portion across the strip width. In any event, the surface roughness of the center portion 150 delivers cast strip downwardly from the nip with varied thicknesses of the metal shells across the strip width and reduced ridges.

In the examples of FIGS. 17 and 18, the casting roll 12 is divided into 15 roughness zones. In these examples, the first edge portion 152 includes zones 1 and 2 and the second edge portion includes zones 14 and 15. The first intermediate portion 154 includes zone 3 and the second intermediate portion 154 includes zone 13. The center portion in FIGS. 17 and 18 includes roughness zones 4 through 12 from 62 to 1282 mm from the first edge of the casting rolls, and is 90% of the width of the casting rolls. It is contemplated that the casting roll 12 may be divided into any number of roughness zones as desired. In another example, not shown, the center portion 150 of the casting roll 12 may be divided into three roughness zones of at least 60% of the width of the casting rolls. Alternatively, the center portion 150 may be divided into between 3 and 20 zones, or more, for controlling the surface roughness along the casting roll.

Each edge portion may be up to about 7% of the casting roll width. Alternately, each edge portions may be up to about 4% of the casting roll width. Each edge portion 152 of the casting rolls 12 is at least 25 mm wide. Alternatively, each edge portion 152 may be at least 50 mm wide. In one alternative, the edge portion is between 25 mm and 75 mm wide. Alternatively, the edge portion is between 50 mm and 75 mm wide. The average surface roughness of the edge portion 152 may be at least 4 Ra. In one alternative, the average surface roughness of the edge portion 152 may be between 5 and 9 Ra. For example, as shown in FIG. 17, the edge portions 152 are zones 1 and 2 and zones 14 and 15, each of 50 mm.

Each intermediate portion 154 of the casting rolls 12 is at least 10 mm wide as shown by zones 3 and 13 of FIG. 17. Alternatively, each intermediate portion 154 of the casting rolls 12 may be at least 25 mm wide. The average surface roughness of the intermediate portion 154 may be at least 5 Ra. In one alternative, the average surface roughness of the intermediate portion 154 may be between 4 and 10 Ra. The intermediate portions 154 may have an average surface roughness between the average surface roughness of the edge portions and the average surface roughness of the center portion.

The roll casting surface 12A may be produced with a surface roughness as produced by grit or shot blasting, with a varied surface roughness along the center portion 150 as desired to produce a varied shell thickness accordingly. An appropriate surface roughness can be imparted to a metal substrate by grit or shot blasting with a hard particulate material for forming a texture such as steel, alumina, silica, or silicon carbide having a particle size of the order of 0.7 to 1.4 mm. Particulate media may be conveyed to the roll surface using compressed air or other mechanical means such as a rotating wheel. The various desired roll surface roughness may be achieved using a desired particulate size or combination of media of different particulate sizes and varying the shot or grit blasting air pressure from 30 to 110 psi. Alternatively, wheel blasting may be used to provide the surface roughness, wherein the particulate media is propelled by a rotating, typically bladed, wheel using controlled centrifugal force. In wheel blasting, the speed of the blasting wheel may be varied to achieve the desired surface roughness. In yet another alternative or in addition to another method, a variable orifice may be provided to control the flow rate of the blast media. A variable orifice may be controlled independently or in conjunction with controlling the air pressure.

Figure 20:
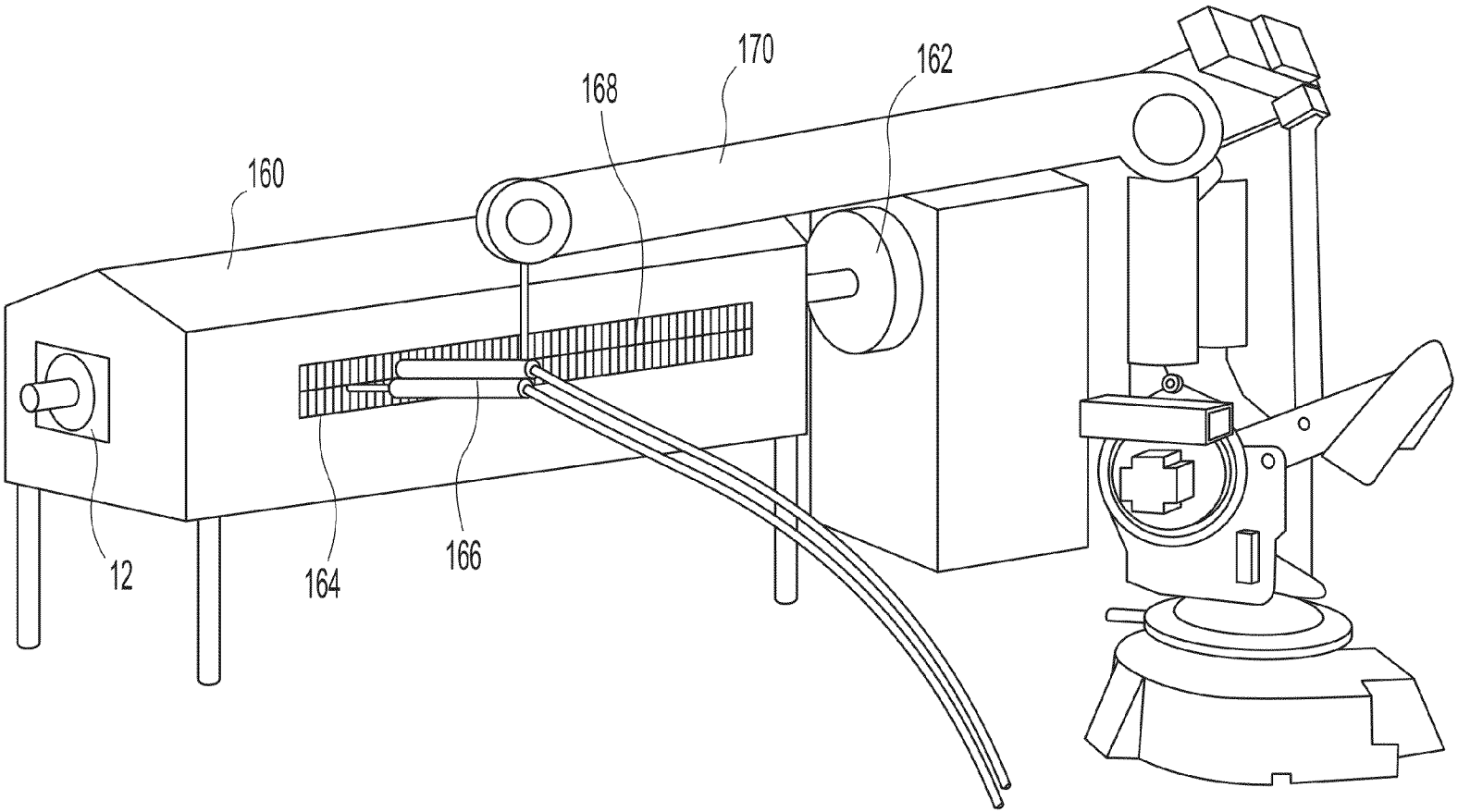
FIG. 20 is a diagrammatical perspective view of a texturing apparatus of the present disclosure.

FIG. 20 describes one example of a texturing apparatus for providing the tapered surface roughness. The tapered surface roughness may be stepped zones, or alternatively may be a continuous linear or non-linear taper based on desired surface roughness and the capabilities and programming of the texturing apparatus. As shown in FIG. 20, the casting roll 12 is positioned in a containment box 160. The casting roll is operatively connected to a variable speed rotational drive 162. The containment box 160 includes an opening 164 along the length of the roll to access the casting roll surface 12A during shot or grit blasting. A nozzle 166 is provided to direct the particulate media through the opening 164 toward the casting roll surface 12A. The opening 164 may be provided with a seal 168 to contain at least a portion of the particulate media during texturing. The seal 168 may be a double brush seal or other configuration adapted to retain the particulate media while allowing movement of the nozzle 166 along the casting roll 12 through the opening 164. The nozzle 166 is operatively connected to a linear actuator 170 to control the movement of the nozzle 166 along the casting roll 12. The linear actuator 170 may be an industrial robot such as shown as an example in FIG. 20. Alternatively, the linear actuator 170 may be a linear motion device to control the nozzle along the casting roll, such as a hydraulic actuator, rack and pinion, linear drive, or other controlled linear motion device. The linear actuator 170 may be covered by a shroud or cover to protect moving parts and bearing surfaces from accumulation of particulate media or other residue.

In the texturing process, the rotational drive 162 rotates the casting roll at a predetermined speed. The particulate media flow starts and the nozzle 166 is directed to the casting surface 12A at one end of the casting roll 12. As the casting roll rotates, the nozzle 166 traverses axially across the casting roll surface at a predetermined speed. In the example of FIG. 17, the casting roll is divided into 15 zones. In this example, the casting roll 12 was rotated at 16 revolutions per minute as the nozzle 166 translated along the casting roll. As the nozzle 166 moves from one zone to another, the air pressure is adjusted higher or lower as specified for the zone, and the rate of translation of the nozzle along the roll is increased or decreased as specified for the zone. In the example of FIG. 17, the flow rate of the particulate media was not varied along the casting roll. It is contemplated, however, that the flow rate may be varied along the casting roll. In the example of FIG. 17, the rate of translation of the nozzle along the roll was varied between 0.75 and about 1.5 inch per minute. Other rates of translation are contemplated corresponding to the rotational speed of the casting roll and the flow rate of the particulate media. The nozzle 166 translates along the casting roll 12 at the predetermined speed at a constant distance from and constant angle to the casting roll surface 12A.

The nozzle 166 may be positioned such that the particulate media impinges on the roll surface substantially perpendicular, or other desired angle, from the tangent of the roll. Alternatively, the nozzle may be varied such that the particulate media impinges on the roll surface between about 60 and 120 degrees from the tangent of the roll. Alternatively or additionally, the nozzle may be moved closer or further from the roll surface during texturing. In the example of FIG. 17, the nozzle was positioned approximately 3 and ⅜ inches from the surface of the casting roll. It is contemplated that the nozzle may be varied between about 2 and 6 inches from the surface of the casting roll.

Prior to forming the surface texture on the casting roll, the roll may have a casting surface roughness of less than 1 Ra. Alternatively, the surface roughness of the casting roll prior to forming the surface texture may be between about 1 and 3 Ra.

The particulate media may be a shot size of S330 according to SAE specification J444. Alternatively the particulate media is a shot size between S280 to S460. The particulate media may be grit, silica, ball, or other particulate media. In one alternative, the particulate media may be a grit size between about G16 and G25 according to SAE specification J444.

The texturing process is controlled to produce a predictable roll surface that is repeatable from one casting roll to another to control the thickness of the shell produced during casting. Texturing process parameters used to produce a desired blast texture and surface roughness include casting roll rotation speed, nozzle to roll surface distance, nozzle to roll surface angularity, nozzle traverse speed, number of texturing passes, particulate media flow rate, air pressure, uniformity of particulate media size and shape, and roll surface texture prior to texturing. As an example, a copper roll surface may be blasted in this way to provide a desired tapered surface roughness and the textured surface protected with a thin chrome coating of the order of 50 microns thickness.

A method of continuously casting metal strip may comprise assembling the presently disclosed casting rolls each having casting surfaces with a center portion and edge portion, each edge portion having an average surface roughness between 3 and 7 Ra and the center portion having an average surface roughness between 1.2 and 4.0 times the surface roughness of the edge portions, and the intermediate portions having an average surface roughness between average surface roughness of the edge portions and the center portion, and laterally positioning said casting rolls to form a gap at a nip between the casting rolls through which thin cast strip can be cast. The center portion is at least 60% of the width of the casting rolls and each edge portion is up to 7% or the width of the casting rolls. The method may include assembling a metal delivery system adapted to deliver molten metal above the nip to form a casting pool supported on the casting surfaces of the casting rolls and confined at the ends of the casting rolls and counter rotating the casting rolls to form metal shells on the casting surfaces of the casting rolls that are brought together at the nip to deliver cast strip downwardly with varied thicknesses of the metal shells across the strip width. Additionally, the gap between the casting rolls 12 at the nip may be varied to assist in control of at least the amount of mushy material between the metal shells and the surface crown. The controlled amount of mushy material between the metal shells may include molten metal and partially solidified metal, and may include all the material between the shells not sufficiently solidified to be self supportive.

In one alternative, the method may include the steps of determining at a reference location downstream from the nip a target temperature profile of the cast strip corresponding to a desired amount of mushy material between the metal shells of the cast strip at the nip, sensing the temperature of the cast strip downstream from the nip at the reference location and producing a sensor signal corresponding to the sensed temperature, and causing an actuator to vary the gap at the nip between the casting rolls in response to the sensor signal received from the sensor and processed to determine the temperature difference between the sensed temperature profile and the target temperature profile.

To control the amount of mushy material between the metal shells, the temperature of the metal shells downstream of the nip may be sensed or measured. Various devices are known for measuring temperature including temperature profile. Such sensors are capable of sensing the strip temperature at a plurality of locations along the strip width and producing an electrical signal indicative of the strip temperature. Alternatively or in addition, the temperature sensor 140 may include a scanning pyrometer or an array temperature sensor.

The temperature sensors 140 may be positioned to sense the temperature of the cast strip in a continuum along the strip width by a scanning pyrometer or other temperature sensing devices. Alternatively, the temperature may be sensed in discrete locations along the strip width. The temperature sensors 140 may be positioned to determine the temperatures of the cast strip in segments across the cast strip. Additionally, temperature sensors 140 may be positioned at a single reference location downstream from the nip or may be positioned at several reference locations downstream from the nip to provide a representative temperature of the cast strip. The temperature sensors 140 may be positioned to sense the temperature at one or more reference locations between about 0.2 meters and 2.0 meters from the nip.

A target temperature profile of the cast strip downstream from the nip at a reference location may be empirically correlated with desired amounts of mushy material between the metal shells of the cast strip. The target temperature profile may be determined from empirical data, which may be updated as desired. Alternatively or in addition, the target temperature profile may be calculated based on the heat transfer properties, thickness, steel chemistry, and other properties of solidifying metal in the cast strip. In any event, the target temperature profile is determined at a reference location downstream from the nip to correspond to a desired amount of mushy material along between the metal shells of the cast strip by available and desired data within desired or available limits of accuracy. Thus, the target temperature profile may actually be a bracketed range of temperatures corresponding to amounts of mushy material along between the metal shells within acceptable tolerances.

Figure 14:
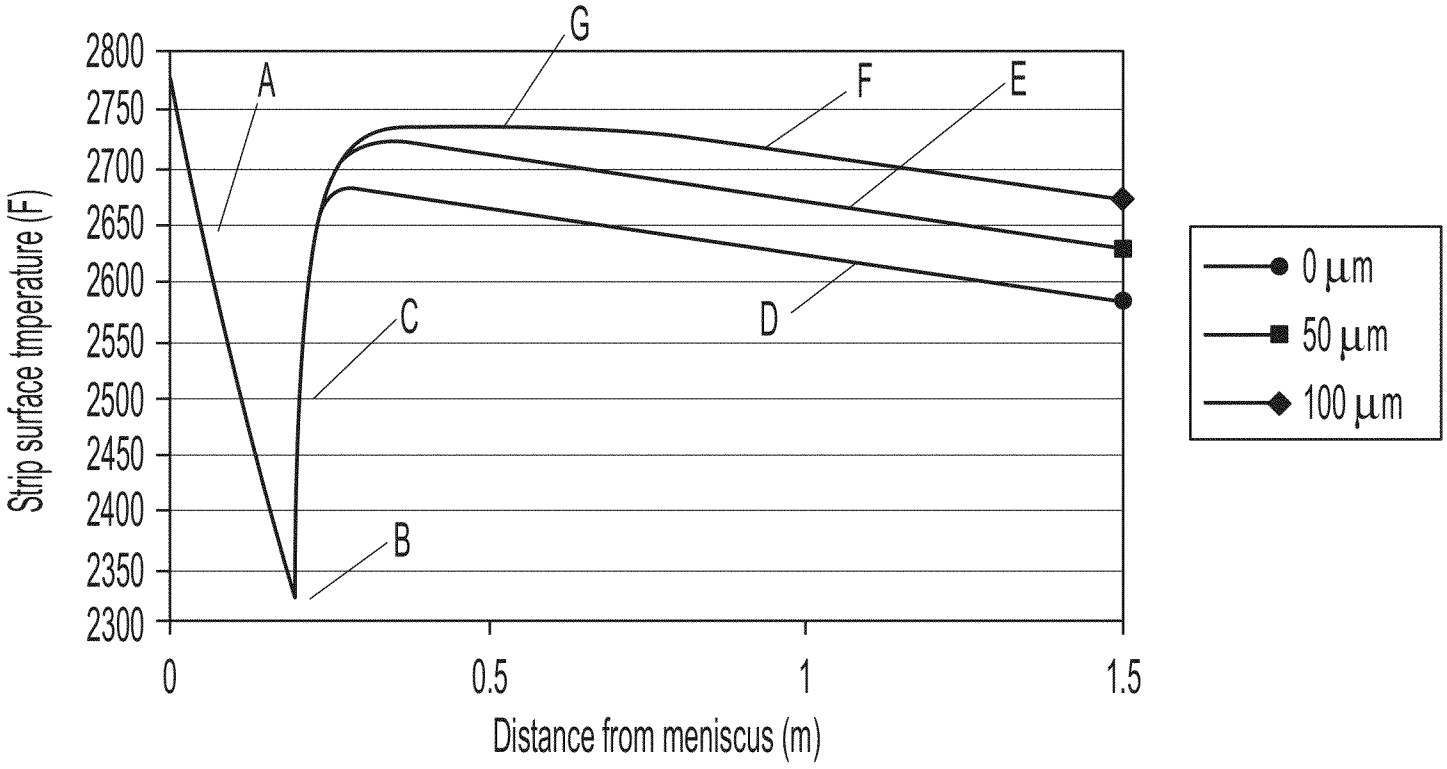
FIG. 14 is a graph of strip temperature.

As shown in FIG. 14, the temperature of the cast strip downstream from the nip may be varied with amounts of mushy material between the metal shells across the width of the casting rolls. In FIG. 14, line A identifies the decreasing temperature of the cast strip while the strip is in contact with the casting surface of the cooled casting rolls. Point B corresponds to the nip where the metal shells separate from the casting rolls to form the cast strip cast downward from the nip. Line C corresponds to the temperature rebound, or rebound heating, that occurs downstream from the nip as the mushy material between the metal shells reheats the metal shells as illustrated by rising strip surface temperature. For a certain amount of mushy material between the shells, the excess temperature from temperature rebound before the hot rolling mill may cause austenite grain growth and a coarser microstructure. Referring to point G, the temperature rebound may re-heat the strip to a temperature forming δ-ferrite, which upon cooling returns to a coarser and more variable austenite microstructure, and in any case, may cause ridges in the cast strip. In severe circumstances, the mushy material may reheat the metal shells to the point of re-melting the metal shells resulting in additional undesired surface defects and potentially even breakage of the cast strip. Effects of temperature rebound may be controlled by controlling the amount of mushy material between the shells with lower amounts of mushy material tending to provide less ridges and other surface defects until the amount of mushy material reduces to where high frequency chatter begins to be seen.

As shown in FIG. 14, the temperature rebound occurs for a distance downstream of the nip, in FIG. 14 as measured from the meniscus level. The extent of temperature rebound or reheating of the cast strip is controlled by the amount of mushy material relative to the amount of the solidified material in the cast strip upon exiting the nip. As shown by lines D, E, and F, after leaving the nip the temperature of the surface of the cast strip increases as the heat from the mushy material transfers to the shells and then begins to decrease as the strip cools. Lines D, E, and F illustrate three calculated examples of temperature rebound for different amounts of mushy material formed between the metal shells during the cast while maintaining the same heat flux through the casting roll surfaces. Line D illustrates the temperature of the cast strip with zero micrometers of mushy material between the metal shells upon exiting the nip. Line E illustrates the temperature of the cast strip with fifty micrometers of mushy material between the metal shells upon exiting the nip. Line F illustrates the temperature of the cast strip with 100 micrometers of mushy material between the metal shells upon exiting the nip. As shown by lines D, E, and F, a greater amount of mushy material between the metal shells upon exiting the nip corresponds to a higher strip temperature or greater temperature rebound of the cast strip downstream of the nip. Using the relationship between the temperature rebound and the amount of mushy material between the metal shells, calculated and/or determined empirically, a target temperature profile of the cast strip downstream from the nip at a reference location may be determined that corresponds to a desired amount of mushy material between the metal shells of the cast strip to reduce both ridges in the strip and high frequency chatter.

Figure 15A:
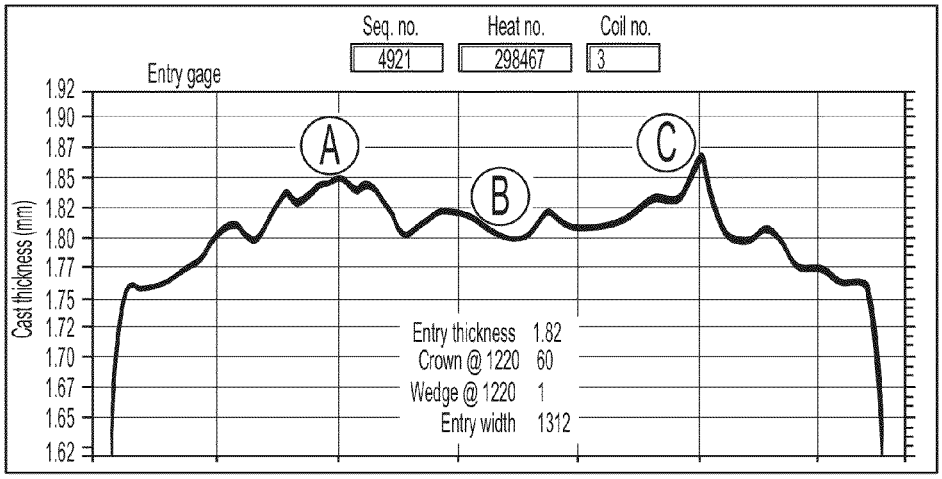
FIG. 15A is a graph of strip thickness profile.
Figure 15B:
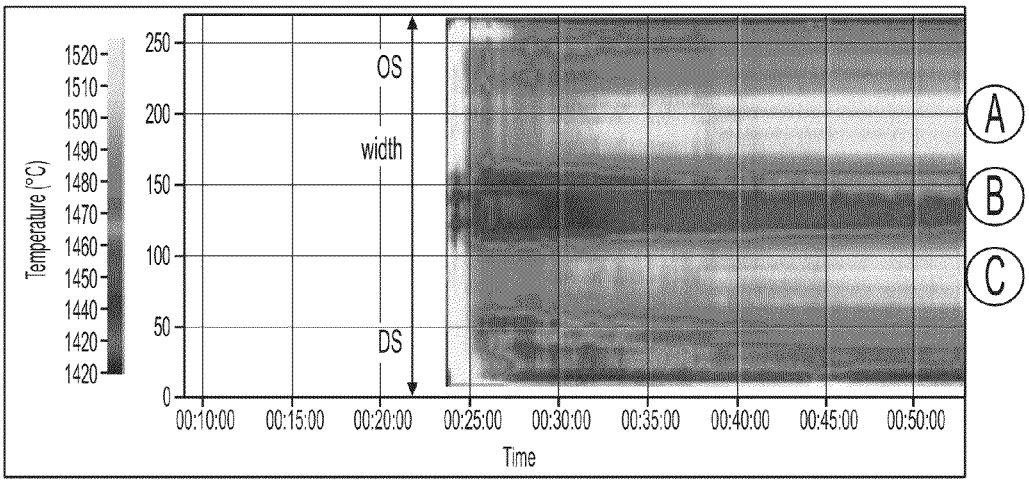
FIG. 15B is a graph of measured strip temperature corresponding to the strip profile of FIG. 15A.
Figure 21:
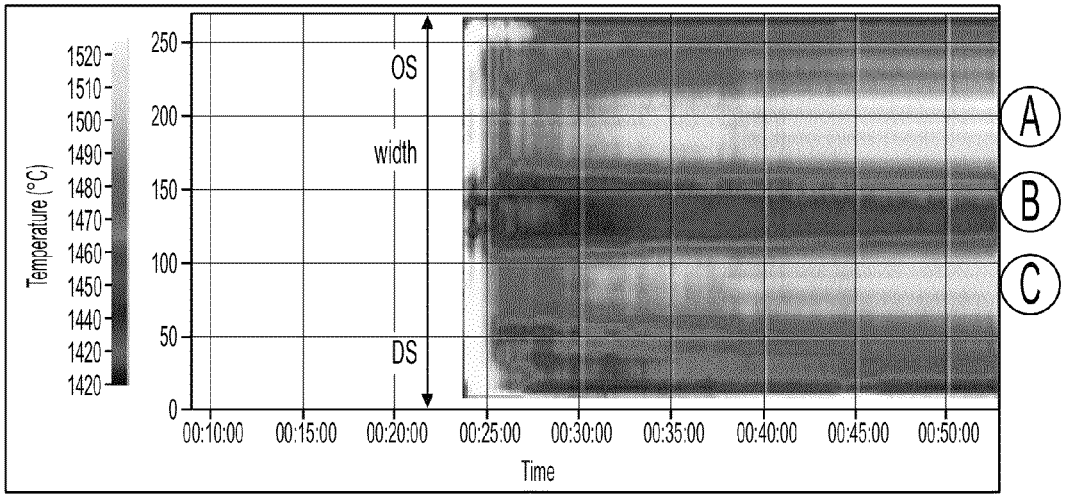
FIG. 21 is a color image of the graph of FIG. 15B.

FIG. 15A is a graph showing the thickness profile of a sample of a prior cast strip across the width of the strip. In this example, the thickness of the cast strip varies across the width of the strip. Reference points A and C identify portions of the cast strip that are thicker than the portion identified by reference point B. Referring now to FIGS. 15B and 21, the temperature of the cast strip across the width of the strip is shown. In FIGS. 15B and 21, the width of the strip is along the y-axis and the temperature of the surface of the cast strip is illustrated over a selected time interval along the x-axis. As illustrated, the temperature of the strip at references points A and C is hotter than the temperature of the cast strip at reference point B. In this example, the thinner portion of the cast strip, reference point B, is approximately 1450° C., whereas the thicker portions of the strip, reference points A and C, are approximately 1500-1520° C. as a result of greater amount of mushy material between the shells.

Figure 16A:
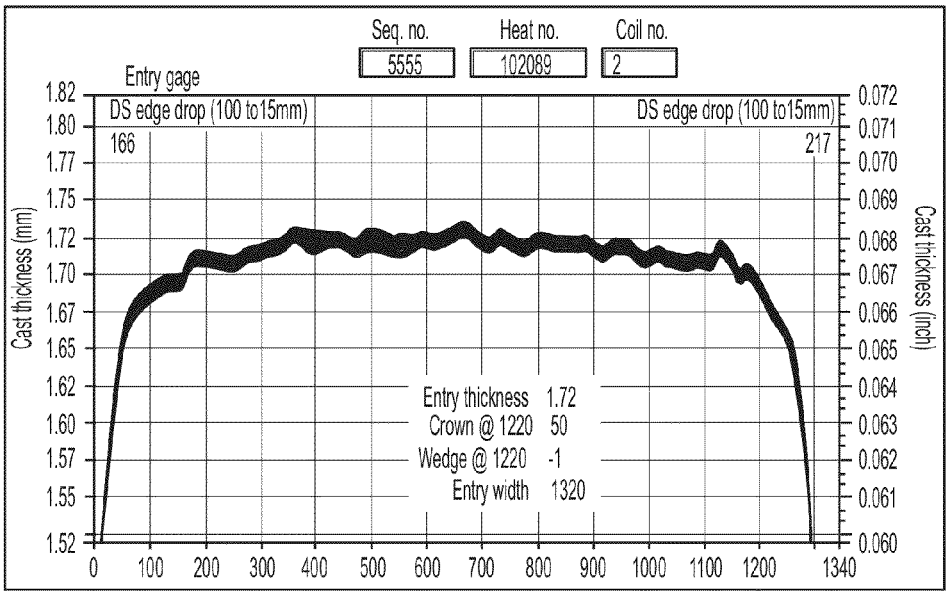
FIG. 16A is an alternative graph of strip thickness profile.
Figure 16B:
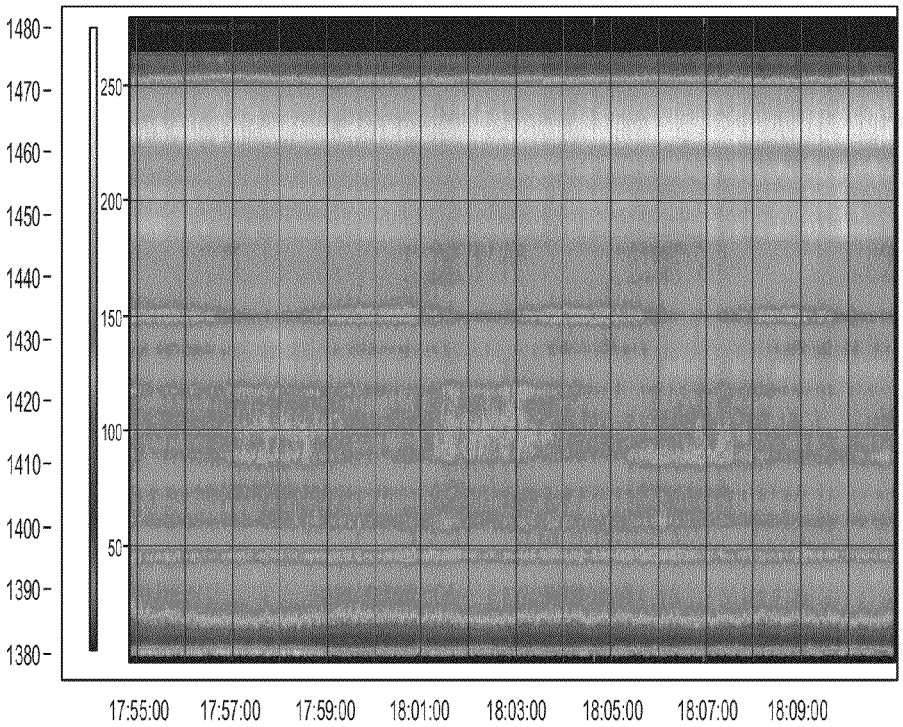
FIG. 16B is an alternative graph of measured strip temperature corresponding to the strip profile of FIG. 16A.
Figure 22:
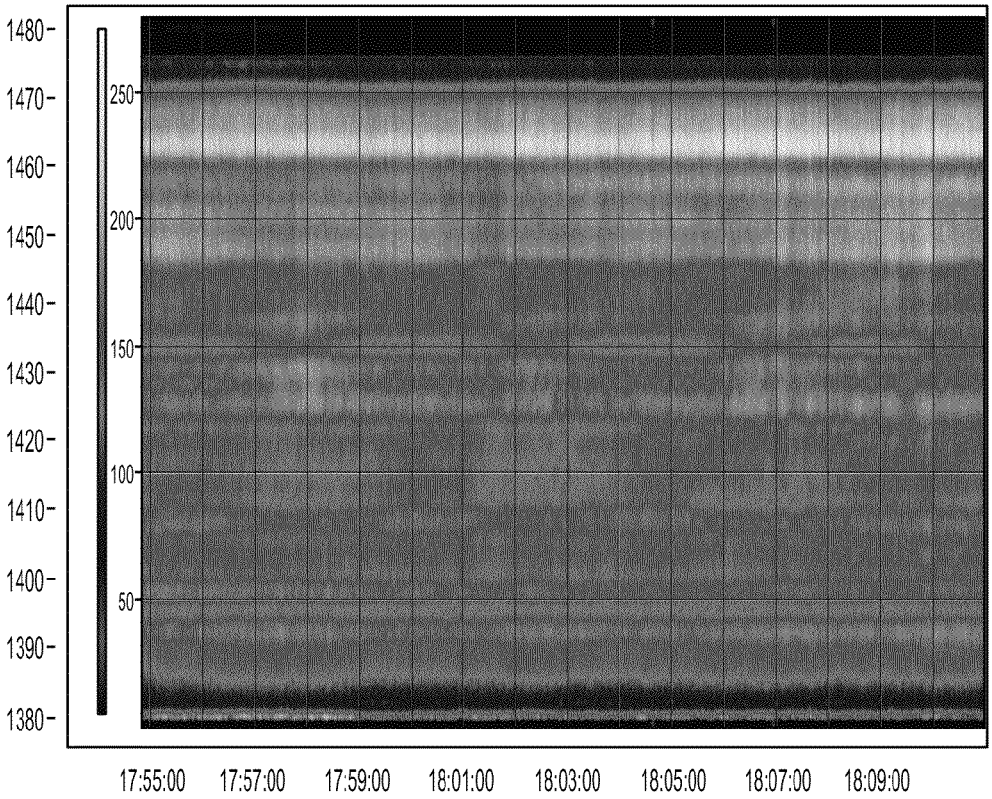
FIG. 22 is a color image of the graph of FIG. 16B.

FIG. 16A is a graph showing the thickness profile of a sample of the present cast strip across the width of the strip. As shown in this example, the thickness of the cast strip has less variation across the width of the strip. Additionally, as shown in FIGS. 16B and 22, the temperature of the cast strip across the width of the present strip has less variation across the width and is generally lower than the temperatures shown in FIGS. 15B and 21. The improved temperature and thickness profiles reflect the controlled amount of mushy material between the metal shells.

The reference location where the strip temperature is measured downstream of the nip may be positioned at various locations. The reference location may be a single location or may be multiple locations downstream of the nip. As shown in FIG. 14, the relationship between the temperature of the cast strip and the amount of mushy material between the metal shells may extend for a distance downstream of the nip and the reference location may be selected within this distance. The reference location may be between about 0.2 meters and 2.0 meters from the nip. In one example, the reference location may be 0.5 meters downstream from the nip. In another example the reference location may be 1 meter downstream from the nip. However, as shown in FIG. 14, a reference location too close to the nip will miss the extent of the temperature rebound, and downstream heat losses will diminish the measurable effect of a reference location too far from the nip. Practical limitations may also be considered in locating the reference location due to the high temperature of the cast strip immediately below the nip.

As is apparent to those of skill in the art, the target temperature profile may be one or more temperatures at one or more reference locations as desired for use in the controller. The target temperature profile may also be determined from a formula for combining multiple temperature measurements.

The temperature of the cast strip may be sensed and a sensor signal may be produced corresponding to the sensed temperature. The sensor signal may be an electrical sensor signal. Additionally, various signal processing techniques such as averaging, summing, differencing, and filtering may be applied to the sensor signal corresponding to the sensed temperature. Such signal processing techniques may improve the performance or stability of the controller 142 and/or improve the quality of the cast strip. The sensor signal may correspond to a single temperature measurement or multiple temperature measurements. The sensor signal may also correspond to a combination of multiple temperature measurements. In another example, multiple sensor signals may be utilized to correspond to the temperature of the cast strip at multiple locations across the width and/or length of the cast strip.

To control the position of the casting rolls 12 an actuator may vary the gap between the casting rolls in response to the sensor signal received from the sensor, and processed to determine the temperature difference between the sensed temperature profile and the target temperature profile. The sensor signal may be processed to determine the temperature difference between the sensed temperature profile and the target temperature profile by any appropriate signal processing techniques, including analog or digital processing.

The gap between the casting rolls 12 at the nip may be varied by servomechanism or another drive to control the amount of mushy material between the metal shells. For example, the gap between the casting rolls may be varied by the actuator to assist in control the amount of mushy material between the metal shells of the cast strip to be between about 10 and 200 micrometers, and more particularly between about 10 and 100 micrometers, in response to the sensor signal processed to determine the temperature difference between the sensed temperature and the target temperature. In another example, the gap between the casting rolls may be varied by the actuator to control the amount of mushy material between the metal shells of the cast strip to be between about 20 and 50 micrometers in response to the processed sensor signal.

The method of continuously casting metal strip may also include counter rotating the casting rolls to provide a casting speed between 40 and 100 meters per minute. In one example, the as-cast thickness of the cast strip may be between 0.6 and 2.4 millimeters. Other as-cast thicknesses are also contemplated depending upon the capabilities of the casting system. In any event, the as-cast thickness may be greater than the desired thickness of the final product after hot rolling of the cast strip.

As previously discussed, a casting pool of molten metal is supported on the casting surfaces of the casting rolls 12 above the nip. The casting pool height may be between about 125 and 225 millimeters above the nip where the casting rolls are between about 450 and 650 millimeters in diameter. In one example, the casting pool height may be between about 160 and 180 millimeters. In another example, the casting pool height may be greater than 250 millimeters above the nip, for example when larger casting rolls are utilized. The casting pool height is measured as the vertical distance between the meniscus of the casting pool and the nip. Additionally, in one example, the heat flux density may be 7 to 15 megawatts per square meter through the casting rolls.

The apparatus for continuously casting metal strip may have a pair of counter-rotatable casting rolls having casting surfaces laterally positioned to form a gap at a nip between the casting rolls through which thin cast strip can be cast, a metal delivery system adapted to deliver molten metal above the nip to form a casting pool supported on the casting surfaces of the casting rolls and confined at the ends of the casting rolls that are brought together at the nip to deliver cast strip downwardly from the nip with a controlled amount of mushy material between the metal shells, a sensor adapted to sensing the temperature of the cast strip cast downstream from the nip at a reference location and producing a sensor signal corresponding to the temperature of the cast strip below the nip, and a controller 142 adapted to control an actuator to vary the gap between the casting rolls to provide a controlled amount of mushy material between the metal shells across the width of the cast strip at the nip in response to the sensor signal received from the sensor and processed to determine the temperature difference between the sensed temperature and a target temperature.

In yet another example, the method of continuously casting metal strip may also include sensing the location or position of the casting rolls, sensing the force exerted on the strip adjacent the nip, and/or sensing the thickness profile of the cast strip downstream of the nip. Sensor signals may be produced corresponding to the location, force, or profile measurements. In addition to the sensor signal corresponding to the sensed temperature of the cast strip to provide a controlled amount of mushy material between the metal shells across the strip width, sensor signals corresponding to the location, force, and/or thickness profile measurements may be used for controlling the location of the rolls, the forces on the rolls, and the downstream thickness profile of the strip.

For example, the location sensors 130 may be provided and positioned capable of sensing the location of the casting rolls 12, and producing electrical signals indicative of each casting roll position to determine the gap between the casting rolls. The controller 142 may be capable of receiving the electrical signals indicative of the position of each casting roll, and causing the actuators to vary the gap at the nip between the casting rolls in response to the sensor signal received from the location sensor and the sensor signal received from the strip temperature sensor 140 processed to determine the temperature difference between the sensed temperature and the target temperature. The location sensors 130 may be linear displacement sensors, such as for example but not limited to voltage differential transducers, variable inductance transducers, variable capacitance transducers, eddy current transducers, magnetic displacement sensors, optical displacement sensors, or other displacement sensors.

The controller 142 may include one or more controllers, such as programmable computers, programmable microcontrollers, microprocessors, programmable logic controllers, signal processors, or other programmable controllers, which are capable of receiving the temperature and roll location sensor signals, processing the sensor signals to determine the temperature difference between the sensed temperature and the target temperature, and providing control signals capable of causing the actuators to move as desired.

Additionally, the controller 142 may control the casting of the strip product responsive to forces exerted on the strip adjacent the nip. The force sensors or load cells 108 are capable of sensing the forces exerted on the strip adjacent the nip and producing electrical signals indicative of the sensed forces on the strip. Then, the controller 142 may be capable of receiving the electrical signals indicative of the sensed forces exerted on the strip and causing the actuators to move the casting rolls responsive to the sensed forces exerted on the strip. The controller 142 may be capable of causing an actuator to move at each end of each casting roll responsive to the sensed forces exerted on the strip. The controller may utilize the temperature, location, and force sensor data to control the casting of the strip product to achieve the desired properties. As described in U.S. Pat. No. 7,464,764, the gauge variations in cast strip can be controlled by having a roll separation force that is higher than that required to balance the ferrostatic pool pressure and to overcome the mechanical friction involved in moving the rolls. In particular, a roll separation force in the range of between 2 and 4.5 Newtons per millimeter has been effective in controlling the quality of the strip.

In yet another embodiment, thickness profile sensors may be positioned downstream of the nip capable of sensing the strip thickness profile at a plurality of locations along the strip width, and producing electrical signals indicative of the strip thickness profile downstream of the nip. In one example, the profile sensors may be positioned adjacent the sensor adapted to sensing the temperature of the cast strip downstream from the nip. Then, the controller 142 may be capable of processing the electrical signals indicative of the strip thickness profile in addition to the sensor signal corresponding to the temperature of the cast strip below the nip, and causing the actuators to move the casting rolls and further control the thickness profile of the cast strip responsive to the electrical signals indicative of the strip thickness profile.

As is apparent, the presently disclosed method and apparatus utilizing temperature sensors 140 may be used with or without the location sensors, force sensors, and profile sensors discussed above.

While the invention has been described with reference to certain embodiments it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiments falling within the scope of the appended claims.

What is claimed is:

1. An apparatus for continuously casting metal strip comprising:

a pair of counter-rotatable casting rolls each having casting surfaces with a center portion of at least 60% of the width of the casting rolls, two edge portions each of up to 7% of the width of the casting rolls, and at least one intermediate portion between each edge portion of the casting rolls and the center portion of the casting rolls, each edge portion having an average surface roughness between 3 and 7 micrometers Ra, the center portion of the casting rolls having an average surface roughness tapered across the width and between 1.2 and 4.0 times the surface roughness of the edge portions of the casting rolls, and the intermediate portions of the casting rolls having an average surface roughness between the average surface roughness of the edge portions of the casting rolls and the center portion of the casting rolls, and laterally positioned to form a gap at a nip between the casting surfaces of the casting rolls through which thin cast strip can be cast, a metal delivery system adapted to deliver molten metal above the nip to form a casting pool supported on the casting surfaces of the casting rolls and confined at the edges of the casting rolls, and a drive system adapted to counter-rotate the casting rolls forming metal shells on the casting surfaces of the casting rolls that are brought together at the nip to deliver cast strip downwardly with varied thicknesses of the metal shells across the strip width.

2. The apparatus for continuously casting metal strip as claimed in claim 1 where the taper of the surface roughness of the center portion across its width is in stepped zones.

3. The apparatus for continuously casting metal strip as claimed in claim 1 where the surface roughness of the center portion is tapered across its width with the middle part of the center portion at least 2 micrometers Ra below the surface roughness at the outermost parts of the center portion.

4. The apparatus for continuously casting metal strip as claimed in claim 2 where the surface roughness of the center portion is tapered across its width with the middle part of the center portion at least 2 micrometers Ra below the surface roughness at the outermost parts of the center portion.

5. The apparatus for continuously casting metal strip as claimed in claim 1 where the surface roughness across each edge portion is within 1.0 micrometers Ra.

6. The apparatus for continuously casting metal strip as claimed in claim 1 where the surface roughness of the center portion being substantially similar across the width.

7. The apparatus for continuously casting metal strip as claimed in claim 1 where each edge portion is between 50 mm and 75 mm wide.

8. The apparatus for continuously casting metal strip as claimed in claim 1 where each edge portion is between 25 mm and 75 mm wide.

9. The apparatus for continuously casting metal strip as claimed in claim 1 where the edge portions have an average surface roughness of between 5 and 7 micrometers Ra.

10. The apparatus for continuously casting metal strip as claimed in claim 1 where the edge portions have an average surface roughness of between 3 and 6 micrometers Ra.

11. The apparatus for continuously casting metal strip as claimed in claim 1 where the casting rolls are between 450 and 650 mm in diameter.

12. The apparatus for continuously casting metal strip as claimed in claim 1 where the surface roughness of the casting surface over the width of the casting rolls is varied in a range between 5 and 15 micrometers Ra.

13. The apparatus for continuously casting metal strip as claimed in claim 1 where the surface roughness of the casting surface of the center portion of the casting rolls is varied in a range between 5 and 15 micrometers Ra.

14. The apparatus for continuously casting metal strip as claimed in claim 1 where the surface roughness of the casting surface over the width of the casting rolls is varied in stepped zones in a range between 5 and 12 micrometers Ra.

15. The apparatus for continuously casting metal strip as claimed in claim 1 where the surface roughness of the casting surface of the center portion of the casting rolls is varied in stepped zones in a range between 5 and 12 micrometers Ra.

16. The apparatus for continuously casting metal strip as claimed in claim 2 where the surface roughness of the casting surface over the width of the casting rolls is varied in stepped zones in a range between 5 and 15 micrometers Ra.

17. The apparatus for continuously casting metal strip as claimed in claim 2 where the surface roughness of the casting surface of the center portion of the casting rolls is varied in stepped zones in a range between 5 and 15 micrometers Ra.

18. The apparatus for continuously casting metal strip as claimed in claim 1 where the casting rolls have a crown shape adapted to form a crown in the cast strip, and the crown shape of the casting roll surface of each casting roll is coordinated with variation in surface roughness across the center portion of the casting surface.

19. The apparatus for continuously casting metal strip as claimed in claim 18 where the crown shape is provided in stepped zones.

20. The apparatus for continuously casting metal strip as claimed in claim 1 where the casting rolls have a crown shape adapted to form a crown in the cast strip, and the crown shape of the casting roll surface of each casting roll is such that edge portions of the cast strip are of a higher temperature than the cast strip in the center portion of the strip width.

21. The apparatus for continuously casting metal strip as claimed in claim 1 where the surface roughness of the casting surface of the center portion of the casting rolls is varied to correspond to a desired variation in metal shell thickness formed for the cast strip.

22. The apparatus for continuously casting metal strip as claimed in claim 1 where the as-cast thickness of the cast strip is between about 0.6 and 2.4 millimeters.

23. The apparatus for continuously casting metal strip as claimed in claim 1 where the casting pool height is between about 125 and 225 millimeters above the nip.

24. An apparatus for continuously casting metal strip with reduced ridges comprising:

a pair of counter-rotatable casting rolls having casting surfaces with at least a center portion and edge portion, the center portion having surface roughness varied and tapered across the width to correspond to a desired variation in metal shell thickness across a cast strip, and laterally positioned to form a gap at a nip between the casting surfaces of the casting rolls through which thin cast strip can be cast, a metal delivery system adapted to deliver molten metal above the nip to form a casting pool supported on the casting surfaces of the casting rolls and confined at the edges of the casting rolls, and a drive system adapted to counter-rotate the casting rolls forming metal shells on the casting surfaces of the casting rolls on the casting surfaces of the casting rolls that are brought together at the nip to deliver cast strip downwardly with varied thicknesses of the metal shells across the strip width.

25. The apparatus for continuously casting metal strip as claimed in claim 24 where intermediate portions are formed in the casting surface of the casting rolls between the center portion and each edge portion.

26. The apparatus for continuously casting metal strip as claimed in claim 24 where the taper of the surface roughness of the center portion across its width is in stepped zones.

27. The apparatus for continuously casting metal strip as claimed in claim 24 where the surface roughness of the center portion is tapered across its width with the middle part of the center portion at least 2 micrometers Ra below the surface roughness at the outermost parts of the center portion.

28. The apparatus for continuously casting metal strip as claimed in claim 26 where the surface roughness of the center portion is tapered across its width with the middle part of the center portion at least 2 micrometers Ra below the surface roughness at the outermost parts of the center portion.

29. The apparatus for continuously casting metal strip as claimed in claim 24 where the surface roughness across each edge portion is within 1.0 micrometers Ra.

30. The apparatus for continuously casting metal strip as claimed in claim 24 where the surface roughness of the center portion being substantially similar across the width.

31. The apparatus for continuously casting metal strip as claimed in claim 24 where each edge portion is between 50 mm and 75 mm wide.

32. The apparatus for continuously casting metal strip as claimed in claim 24 where each edge portion is between 25 mm and 75 mm wide.

33. The apparatus for continuously casting metal strip as claimed in claim 24 where the edge portions have an average surface roughness of between 5 and 7 micrometers Ra.

34. The apparatus for continuously casting metal strip as claimed in claim 24 where the edge portions have an average surface roughness of between 3 and 6 micrometers Ra.

35. The apparatus for continuously casting metal strip with reduced ridges as claimed in claim 24 where the casting rolls are between 450 and 650 mm in diameter.

36. The apparatus for continuously casting metal strip with reduced ridges as claimed in claim 24 where the surface roughness of the casting surface over the width of the casting rolls is varied in a range between 5 and 15 micrometers Ra.

37. The apparatus for continuously casting metal strip with reduced ridges as claimed in claim 24 where the surface roughness of the casting surface of the center portion of the casting rolls is varied in a range between 5 and 15 micrometers Ra.

38. The apparatus for continuously casting metal strip with reduced ridges as claimed in claim 24 where the surface roughness of the casting surface over the width of the casting rolls is varied in a range between 5 and 12 micrometers Ra.

39. The apparatus for continuously casting metal strip with reduced ridges as claimed in claim 24 where the surface roughness of the casting surface of the center portion of the casting rolls is varied in a range between 5 and 12 micrometers Ra.

40. The apparatus for continuously casting metal strip with reduced ridges as claimed in claim 26 where the surface roughness of the casting surface over the width of the casting rolls is varied in a range between 5 and 15 micrometers Ra.

41. The apparatus for continuously casting metal strip with reduced ridges as claimed in claim 26 where the surface roughness of the casting surface of the center portion of the casting rolls is varied in a range between 5 and 15 micrometers Ra.

42. The apparatus for continuously casting metal strip with reduced ridges as claimed in claim 24 where the casting rolls have a crown shape adapted to form a crown in the cast strip, and the crown shape of the casting roll surface of each casting roll is coordinated with variation surface roughness across said center portion of the casting surface.

43. The apparatus for continuously casting metal strip as claimed in claim 42 where the crown shape is provided in stepped zones.

44. The apparatus for continuously casting metal strip with reduced ridges as claimed in claim 24 where the casting rolls have a crown shape adapted to form a crown in the cast strip, and the crown shape of the casting roll surface of each casting roll is such that edge portions of the cast strip is of a higher temperature than the cast strip in the center portion of the strip width.

45. The apparatus for continuously casting metal strip as claimed in claim 24 where the surface roughness of the casting surface of the center portion of the casting rolls is varied to correspond to a desired variation in metal shell thickness formed for the cast strip.

46. The apparatus for continuously casting metal strip with reduced ridges as claimed in claim 24 where the as-cast thickness of the cast strip is between about 0.6 and 2.4 millimeters.

47. The apparatus for continuously casting metal with reduced ridges as claimed in claim 24 where the casting pool height is between about 125 and 225 millimeters above the nip.

* * * * *